US006610644B1

(12) United States Patent
Fenney et al.

(10) Patent No.: US 6,610,644 B1
(45) Date of Patent: Aug. 26, 2003

(54) DETERGENT COMPOSITIONS COMPRISING AGGOLOMERATES OF LAYERED SILICATE AND ANIONIC SURFACTANT

(75) Inventors: Michael Keith Fenney, Newcastle upon Tyne (GB); David Urquhart, Newcastle upon Tyne (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/009,428

(22) PCT Filed: Jul. 8, 1999

(86) PCT No.: PCT/US99/15309

§ 371 (c)(1),
(2), (4) Date: Nov. 8, 2001

(87) PCT Pub. No.: WO00/02436

PCT Pub. Date: Jan. 20, 2000

(30) Foreign Application Priority Data

Jul. 8, 1998 (GB) ..... 9814704

(51) Int. Cl.[7] ..... C11D 17/00; C11D 1/12; C11D 3/08

(52) U.S. Cl. ..... 510/444; 510/276; 510/334; 510/444; 510/445; 510/450; 510/511; 510/531

(58) Field of Search ..... 510/276, 334, 510/444, 445, 450, 511, 531

(56) References Cited

U.S. PATENT DOCUMENTS 5,108,646 A * 4/1992 Beerse et al. ..... 252/174.25
5,540,855 A * 7/1996 Baillely et al. ..... 510/276

FOREIGN PATENT DOCUMENTS

| | | | | |
|---|---|---|---|---|
| EP | 0 688 861 | A1 | | 12/1995 |
| WO | WO 92/07932 | A1 | | 5/1992 |
| WO | 95/07932 | | * | 5/1992 |
| WO | WO 94/03568 | A1 | | 2/1994 |
| WO | WO 98/00490 | A1 | | 1/1998 |
| WO | 98/00490 | | * | 1/1998 |

* cited by examiner

*Primary Examiner*—Charles Boyer
(74) *Attorney, Agent, or Firm*—Brian M. Bolam; Kim William Zerby; Steven W. Miller

(57) ABSTRACT

The invention provides a detergent composition comprising from 0.5 to 60% by weight of an agglomerate comprising from 35 to 68% by weight of the agglomerate of a crystalline layered silicate, from 32 to 55% by weight of the agglomerate of an anionic surfactant and comprising less than 10% by weight of the agglomerate of free moisture.

8 Claims, No Drawings

DETERGENT COMPOSITIONS COMPRISING AGGOLOMERATES OF LAYERED SILICATE AND ANIONIC SURFACTANT

TECHNICAL FIELD

The invention provides detergent compositions which comprise a component which delivers surfactancy to the wash solution and provides building of the wash solution.

BACKGROUND

In the last decade, detergent manufacturers have developed numerous builder systems as replacement for phosphate builders. The main focus has been to improve existing builder combinations based on silicates and polycarboxylates by varying levels and ratios of the builder components. At present most detergents on the market employ aluminosilicates, amorphous or crystalline silicates, maleic or acrylic acid polymers, citrate and carbonate as builders or dispersants. Some effort has been focused on providing improved builder components such as, for example, described in WO95/06705, WO92/07932 Ep668861-A and WO95/06706, which describe silicates which are mixed with other detergent ingredients, prior to addition to the base detergent, or which are roller compacted.

The focus has also been to develop solid compacted detergents. Whilst these compacted detergents have several advantages in use, they have as a disadvantage that they do not always dispense well from the dispensing drawer or from a dispensing device and they do not always dispense or dissolve well in the wash solution. Therefore, in recent years, much effort has been spent on developing products which dispense or dissolve well, reducing residues on fabrics and in the washing machine. For example, effervescence systems based on citric acid have been suggested or used in solid detergents to provide dispensing or dispersing of the product.

More soluble alternative ingredients have also been suggested. However, often even those ingredients which dissolve satisfactory, such as certain surfactants and builder salts, form gels upon contact with small amounts of water. These gels do not dispense well, which leads to a inefficient delivery of the product to the wash and a reduced cleaning performance. The inventors have found that in particular dense granules comprising high levels of surfactants and dense granules comprising high levels of alumnosilicates and granules comprising high levels of water can cause gelling and dissolution problems. Furthermore, another problem associated with those certain ingredients which have a tendency to gel is that they may have a tendency to cake, resulting in a reduced flowability of the product.

The suggested methods to improve dispensing or dissolution are often expensive and complex. For example, the addition of citric acid in high levels to provide effective effervescence is costly and may be difficult because the citric acid may react with moisture upon storage, resulting in a reduced effervescence and possibly caking of product.

Also, the inventors have found that the use of most dispensing aids known in the art does not always provide both a reduction of residues on fabrics and on the washing machine. The inventors have namely found that often those ingredients which dispense sufficiently, do not dissolve well and have a tendency to deposit and form residues on the fabrics in the wash, such as for example aluminosilicates, which are the most commonly used builders for detergents.

The inventors have now found that these problems can be ameliorated by incorporation in the detergent composition of a component comprising specific amounts of crystalline layered silicate intimately mixed, preferably by agglomeration, with specific amounts of an anionic surfactant and preferably only small amounts of free moisture. The component is mixed with the other detergent components as a separate component. Agglomerates of crystalline layered silicate comprising high levels of water are disclosed in WO92/07932 (Procter & Gamble), which however describes aluminosilicates to be more preferred builder ingredients than crystalline layered silicates. EP425804 discloses particles comprising high levels of aluminosilicate, surfactant and crystalline layered silicates.

However, these agglomerates known in the art are often exactly those ingredients which are found to cause dispensing problems in detergents.

They inventors have found that the specific levels of crystalline layered silicate, anionic surfactant and free moisture are essential to ameliorate these problems. They have found that detergents comprising this component have excellent building, surfactancy and flowability and the required alkalinity and that they also dispense and dissolve well in the washing water, thus resulting in excellent cleaning, reduced gelling and reduced deposition of insolubles on the fabrics and on the washing machine.

Furthermore, they have found that the use of this component allows the use of reduced levels, or elimination from the product, of water insoluble or gelling builders or surfactants.

SUMMARY OF THE INVENTION

The invention provides a detergent composition comprising of from 0.5% to 60% by weight of an agglomerate comprising from 35% to 68% by weight of the agglomerate of a crystalline layered silicate, from 32% to 55% by weight of the agglomerate of an anionic surfactant and comprising less than 10% by weight of the agglomerate of free moisture.

The compositions are preferably solid detergents which preferably have a density of at least 500 g/liter and which preferably do not comprise phosphate builders.

The compositions preferably comprise the builder component at a level of at least 5% or even at least 7% by weight of the composition and preferably at a level such that other optional builders, in particular aluminosilicates, carbonates and polymeric polycarboxylates only need to be used in small amounts or can even be dispensed of.

DETAILED DESCRIPTION OF THE INVENTION

The Agglomerate

The agglomerate is present in the detergent composition of the invention at a level of from 0.5% to 60%, preferably from 3% to 50%, more preferably from 5% to 45%, even more preferably at a level of at least 7% by weight of the composition.

The agglomerate comprises from 35% to 68% by weight of the agglomerate of a of a crystalline layered silicate, more preferably from 45% to 62% by weight.

The agglomerate comprises from 32% to 55% by weight of the agglomerate of an anionic surfactant, more preferably from 38% to 48%.

The agglomerate comprises less than 10% by weight of the agglomerate of free moisture, preferably less than 5%, or even less than 3% or even less than 2% by weight of the agglomerate. The free moisture content as used herein, can be determined by placing 5 grams of the agglomerate in a petri dish and placing this petri dish in a convection oven at 50° C. for 2 hours, and subsequently measuring the weight loss, due to water evaporation.

Highly preferred may be that the anionic surfactant comprises from 50% to 100% by weight, preferably from 60% or even 75% to 100% of the anionic surfactant of a sulphonate surfactant preferably an alkyl benzene sulphonate surfactant, as described herein.

Preferably, the weight ratio of the crystalline layered silicate to the anionic surfactant in the intimate mixture is from 4:5 to 7:3, more preferably from 1:1 to 2:1, most preferably from 5:4 to 3:2.

The agglomerate may be prepared by any agglomeration process known in the art, involving mixing the components and agglomerating the components, optionally followed by a drying step or a dusting step or a spray-on step. The agglomerate is then preferably mixed with the other detergent ingredients.

The agglomerate may also comprise additional ingredients, for example in amounts of from 0% to 25%, generally no greater than 20% or even 15% by weight of the agglomerate. The precise nature of these additional ingredients, and levels of incorporation thereof will depend on the application of the component or compositions and the physical form of the components and the compositions.

It may be preferred that the agglomerate comprises less than 15% or even less 10% or even 5% by weight of the agglomerate of nonionic ethoxylated alcohol surfactant, preferably less than 15%, or even less than 10% or even less than 5% of any nonionic surfactant.

It may be preferred that the agglomerate comprises less than 10% by weight, preferably less than 5% by weight of an aluminosilicate material. If any aluminosilicate material is present, it may be preferred that the agglomerate is dusted with the aluminosilicate material.

It may be preferred that the intimate mixture comprises polymeric binder material. Hereby, it is preferred to use as little binder material as possible. It may be preferred that the intimate mixture comprises less than 25%, preferably less than 10%, more preferably less than 5% by weight, most preferably 0% by weight of ethylene oxide polymers.

The agglomerate preferably has a weight average particle size of from 150 microns to 1500 microns, or more preferably 80% by weight of the particles has an particle size of more than 300 microns (80% by weight on Tyler sieve mesh 48) and less than 10% by weight of the particles has a particle size of more than 1180 microns or even 710 microns (on Tyler mesh sieve24).

Preferably, the density of the agglomerate is from 380 g/liter to 1500 g/liter, or more preferably from 500 g/liter to 1200 g/liter, more preferably from 550 g/liter to 900 g/liter.

The agglomerate can be present in the detergent compositions of the invention as a separate particle, or it may be further mixed with other detergent ingredients, including by further agglomeration, compaction, tabletting or extrusion.

The detergent compositions may have any physical form, including aqueous and non-aqueous liquids, solid compositions including flakes, bars and extrudates, but preferably granules or tablets.

Crystalline Layered Silicate

The preferred crystalline layered silicate herein have the general formula $$NaMSi_xO_{2x+1}.yH_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purpose of the present invention, x in the general formula above has a value of 2, 3 or 4 and is preferably 2. M is preferably H, K or Na or mixtures thereof, preferably Na. The most preferred material is $\alpha$-$Na_2Si_2O_5$, $\beta$-$Na_2Si_2O_5$ or $\delta$-$Na_2Si_2O_5$, or thereof, preferably being at least 75% -$Na_2Si_2O_5$, for example available from Clariant as NaSKS-6.

The crystalline layered silicate material, in particular of the formula $Na_2Si_2O_5$ may optionally comprise other elements such as B, P, S, for example obtained by processes as described in EP 578986-B.

It may be preferred that the crystalline layered silicate is a coarse material having an weight average particle size above 150 microns, as measurable by sieving on Tyler sieves, or fine material of weight average particle size below 15 microns, Malvern Instruments SB.OC light scattering equipment.

It may also be preferred that at least 95% or even 98% or even 100% by weight of the crystalline layered silicate has a particle size of less than 102 microns or more preferably less than 88.2 microns or even less than 65.6 microns, whilst having a weight average particle size of more than 15.0 microns, preferably from 16.0 to 48.8 microns or even from 17.3 to 42.1 microns, as measured with a Malvern Instruments SB.OC light scattering equipment. Preferably, when the weight average particle is from 16.0 to 48.8 microns, at least 90% by weight of the particle has a particle size of from 17.3 to 88.2 and when the weight average particle is from 17.3 to 42.1 microns, at least 90% by weight of the particle has a particle size of from 23.3 to 76.0, as measured with a Malvern Instruments SB.OC light scattering equipment.

It may be preferred that the crystalline layered silicate is ground material, preferably obtained by grinding in an air jet mill or ceramic ball mill coarse crystalline layered silicate material.

Anionic Surfactant

The compositions of the invention contain one or more anionic surfactants, whereof at least a part is agglomerated with the crystalline layered silicate material. Thus, it should be understood that for the purpose of the invention the detergent composition may comprise anionic surfactant which is not present in the agglomerate with the crystalline layered silicate.

Preferably, the agglomerate comprises as anionic surfactant at least 50% by weight of the surfactant in the agglomerate, an sulphonate surfactant, preferably an alkyl sulphonate surfactant, as described herein. More preferably, the sulphonate surfactant is from 50% to 100% or even from 60% to 100% or even from 75% to 100% by weight of the total amount of anionic surfactant in the agglomerate. It may be preferred that only anionic surfactant is a sulphonate surfactant.

Anionic Surfactant

Essentially any anionic surfactants useful for detersive purposes can be comprised in the detergent composition or the agglomerates thereof. These can include salts (including, for example, sodium, potassium, ammonium, and substituted ammonium salts such as mono-, di- and triethanolamine salts) of the anionic sulfate, carboxylate and sarcosinate surfactants and preferably sulphonate surfactants.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulphonate Surfactant

Highly preferred herein, in particular in the agglomerate with the crystalline layered silicate, are anionic sulphonate surfactants. Particularly suitable for use herein include the salts of $C_5$–$C_{20}$ linear or branched alkylbenzene sulphonates, but also may be used alkyl ester sulphonates, $C_6$–$C_{22}$ primary or secondary alkane sulphonates, $C_6$–$C_{24}$ olefin sulphonates, sulphonated polycarboxylic acids, alkyl glycerol sulphonates, fatty acyl glycerol sulphonates, fatty oleyl glycerol sulphonates, and any mixtures thereof. Most preferred are $C_9$–$C_{14}$ linear alkyl benzene sulphonates.

Anionic Sulfate Surfactant

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N—($C_1$–$C_4$ alkyl) and —N—($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–$C_{18}$, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and/or sulfonate and alkyl ethoxysulfate surfactants. Such mixtures have been disclosed in PCT Patent Application No. WO 93/18124.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_2O)_xCH_2COO^-M^+$ wherein R is a $C_6$ to $C_{18}$ alkyl group, x ranges from 0 to 10, and the ethoxylate distribution is such that, on a weight basis, the amount of material where x is 0 is less than 20% and M is a cation. Suitable alkyl polyethoxy polycarboxylate surfactants include those having the formula RO—($CHR_1$—$CHR_2$—O)—$R_3$ wherein R is a $C_6$ to $C_{18}$ alkyl group, x is from 1 to 25, $R_1$ and $R_2$ are selected from the group consisting of hydrogen, methyl acid radical, succinic acid radical, hydroxysuccinic acid radical, and mixtures thereof, and $R_3$ is selected from the group consisting of hydrogen substituted or unsubstituted hydrocarbon having between 1 and 8 carbon atoms, and mixtures thereof.

Suitable soap surfactants include the secondary soap surfactants which contain a carboxyl unit connected to a secondary carbon. Preferred secondary soap surfactants for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid and 2-pentyl-1-heptanoic acid. Certain soaps may also be included as suds suppressors.

Alkali Metal Sarcosinate Surfactant

Other suitable anionic surfactants are the alkali metal sarcosinates of formula R-CON ($R^1$) $CH_2$ COOM, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Mid-chain Branched Anionic Surfactants

Highly preferred herein, in particular for providing an improved surfactant performance, are alkyl chain, mid-chain branched surfactant compounds of the above formula wherein the $A^b$ moiety is a branched primary alkyl moiety having the formula:

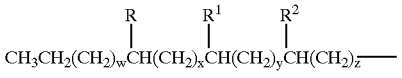

wherein the total number of carbon atoms in the branched primary alkyl moiety of this formula (including the R, $R^1$, and $R^2$ branching) is from 13 to 19; R, $R^1$, and $R^2$ are each independently selected from hydrogen and $C_1$–$C_3$ alkyl (preferably methyl), provided R, $R^1$, and $R^2$ are not all hydrogen and, when z is 0, at least R or $R^1$ is not hydrogen; w is an integer from 0 to 13; x is an integer from 0 to 13; y is an integer from 0 to 13; z is an integer from 0 to 13; and w+x+y+z is from 7 to 13.

In general, for the mid-chain branched surfactant compounds of the surfactant system, certain points of branching (e.g., the location along the chain of the R, $R^1$, and/or $R^2$ moieties in the above formula) are preferred over other points of branching along the backbone of the surfactant. The formula below illustrates the mid-chain branching range (i.e., where points of branching occur), preferred mid-chain branching range, and more preferred mid-chain branching range for mono-methyl branched alkyl $A^b$ moieties useful according to the present invention.

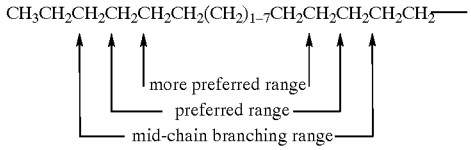

It should be noted that for the mono-methyl substituted surfactants these ranges exclude the two terminal carbon atoms of the chain and the carbon atom immediately adjacent to the -X -B group.

The formula below illustrates the mid-chain branching range, preferred mid-chain branching range, and more preferred mid-chain branching range for di-methyl substituted alkyl $A^b$ moieties useful according to the present invention.

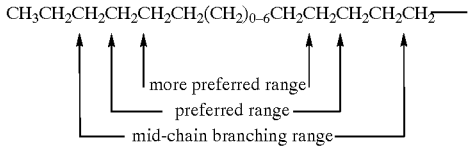

Preferred are surfactant compounds wherein in the above formula the $A^b$ moiety does not have any quaternary substituted carbon atoms (i.e., 4 carbon atoms directly attached to one carbon atom).

The most preferred mid-chain branched surfactants compounds for use in the detergent compositions herein are mid-chain branched primary alkyl sulfonate and, even more preferably, sulfate surfactants. It should be understood that for the purpose of the invention, it may be preferred that the surfactant system comprises a mixture of two or more mid-chain branched primary alkyl sulfate or sulphonate surfactants.

Preferred mid-chain branched primary alkyl sulfate surfactants are of the formula

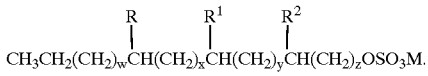

These surfactants have a linear primary alkyl sulfate chain backbone (i.e., the longest linear carbon chain which includes the sulfated carbon atom) which preferably comprises from 12 to 19 carbon atoms and their branched primary alkyl moieties comprise preferably a total of at least 14 and preferably no more than 20, carbon atoms. In the surfactant system comprising more than one of these sulfate surfactants, the average total number of carbon atoms for the branched primary alkyl moieties is preferably within the range of from greater than 14.5 to about 17.5. Thus, the surfactant system preferably comprises at least one branched primary alkyl sulfate surfactant compound having a longest linear carbon chain of not less than 12 carbon atoms or not more than 19 carbon atoms and the total number of carbon atoms including branching must be at least 14, and further the average total number of carbon atoms for the branched primary alkyl moiety is within the range of greater than 14.5 to about 17.5.

R, $R^1$, and $R^2$ are each independently selected from hydrogen and $C_1$–$C_3$ alkyl group (preferably hydrogen or $C_1$–$C_2$ alkyl, more preferably hydrogen or methyl, and most preferably methyl), provided R, $R^1$, and $R^2$ are not all hydrogen. Further, when z is 1, at least R or $R^1$ is not hydrogen.

M is hydrogen or a salt forming cation depending upon the method of synthesis. Examples of salt forming cations are lithium, sodium, potassium, calcium, magnesium, quaternary alkyl amines having the formula

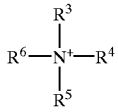

wherein $R^3$, $R^4$, $R^5$ and $R^6$ are independently hydrogen, $C_1$–$C_{22}$ alkylene, $C_4$–$C_{22}$ branched alkylene, $C_1$–$C_6$ alkanol, $C_1$–$C_{22}$ alkenylene, $C_4$–$C_{22}$ branched alkenylene, and mixtures thereof. Preferred cations are ammonium ($R^3$, $R^4$, $R^5$ and $R^6$ equal hydrogen), sodium, potassium, mono-, di-, and trialkanol ammonium, and mixtures thereof. The monoalkanol ammonium compounds of the present invention have $R^3$ equal to $C_1$–$C_6$ alkanol, $R^4$, $R^5$ and $R^6$ equal to hydrogen; trialkanol ammonium compounds of the present invention have $R^3$ and $R^4$ equal to $C_1$–$C_6$ alkanol, $R^5$ and $R^6$ equal to hydrogen; trialkanol ammonium compounds of the present invention have $R^3$, $R^4$ and $R^5$ equal to $C_1$–$C_6$ alkanol, $R^6$ equal to hydrogen. Preferred alkanol ammonium salts of the present invention are the mono-, di- and tri-quaternary ammonium compounds having the formulas:

$$H_3N^+CH_2CH_2OH,\ H_2N^+(CH_2CH_2OH)_2,\ HN^+(CH_2CH_2OH)_3.$$

Preferred M is sodium, potassium and the $C_2$ alkanol ammonium salts listed above; most preferred is sodium.

Further regarding the above formula, w is an integer from 0 to 13; x is an integer from 0 to 13; y is an integer from 0 to 13; z is an integer of at least 1; and w+x+y+z is an integer from 8 to 14.

A preferred mid-chain branched primary alkyl sulfate surfactant is, a C16 total carbon primary alkyl sulfate surfactant having 13 carbon atoms in the backbone and having 1, 2, or 3 branching units (i.e., R, $R^1$ and/or $R^2$) of in total 3 carbon atoms, (whereby thus the total number of carbon atoms is at least 16). Preferred branching units can be one propyl branching unit or three methyl branching units.

Another preferred surfactant system of the present invention have one or more branched primary alkyl sulfates having the formula

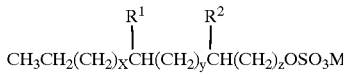

wherein the total number of carbon atoms, including branching, is from 15 to 18, and when more than one of these sulfates is present, the average total number of carbon atoms in the branched primary alkyl moieties having the above formula is within the range of greater than 14.5 to about 17.5; $R^1$ and $R^2$ are each independently hydrogen or $C_1$–$C_3$ alkyl; M is a water soluble cation; x is from 0 to 11; y is from 0 to 11; z is at least 2; and x+y+z is from 9 to 13; provided $R^1$ and $R^2$ are not both hydrogen.

Preferably, the surfactant system comprises at least 20% by weight of the system, more preferably at least 60% by weight, even more preferably at least 90% by weight of the system, of a mid chain branched primary alkyl sulfates, preferably having $R^1$ and $R^2$ independently hydrogen or methyl, provided $R^1$ and $R^2$ are not both hydrogen; x+y is equal to 8, 9, or 10 and z is at least 2, whereby the average total number of carbon atoms in these sulfate surfactants is preferably from 15 to 17, more preferably from 16–17.

Furthermore, preferred surfactant systems are those, which comprise at least about 20%, more preferably at least 60%, even more preferably at least 905 by weight of the system, of one or more mid-chain branched alkyl sulfates having the formula:

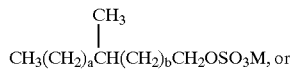

(I)

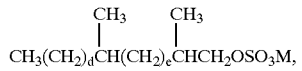

(II)

or mixtures thereof; wherein M represents one or more cations; a, b, d, and e are integers, a+b is from 10 to 16, d+e is from 8 to 14 and wherein further when a+b=10, a is an integer from 2 to 9 and b is an integer from 1 to 8;

when a+b=11, a is an integer from 2 to 10 and b is an integer from 1 to 9;

when a+b=12, a is an integer from 2 to 11 and b is an integer from 1 to 10;

when a+b=13, a is an integer from 2 to 12 and b is an integer from 1 to 11;

when a+b=14, a is an integer from 2 to 13 and b is an integer from 1 to 12;

when a+b=15, a is an integer from 2 to 14 and b is an integer from 1 to 13;

when a+b=16, a is an integer from 2 to 15 and b is an integer from 1 to 14;

when d+3=8, d is an integer from 2 to 7 and e is an integer from 1 to 6;

when d+3=9, d is an integer from 2 to 8 and e is an integer from 1 to 7;

when d+3=10, d is an integer from 2 to 9 and e is an integer from 1 to 8;

when d+3=11, d is an integer from 2 to 10 and e is an integer from 1 to 9;

when d+3=12, d is an integer from 2 to 11 and e is an integer from 1 to 10;

when d+3=13, d is an integer from 2 to 12 and e is an integer from 1 to 11;

when d+3=14, d is an integer from 2 to 13 and e is an integer from 1 to 12;

whereby, when more than one of these sulfate surfactants is present in the surfactant system, the average total number of carbon atoms in the branched primary alkyl moieties having the above formulas is within the range of greater than 14.5 to about 17.5.

Preferred mono-methyl branched primary alkyl sulfates are selected from the group consisting of: 3-methyl pentadecanol sulfate, 4-methyl pentadecanol sulfate, 5-methyl pentadecanol sulfate, 6-methyl pentadecanol sulfate, 7-methyl pentadecanol sulfate, 8-methyl pentadecanol sulfate, 9-methyl pentadecanol sulfate, 10-methyl pentadecanol sulfate, 11-methyl pentadecanol sulfate, 12-methyl pentadecanol sulfate, 13-methyl pentadecanol sulfate, 3-methyl hexadecanol sulfate, 4-methyl hexadecanol sulfate, 5-methyl hexadecanol sulfate, 6-methyl hexadecanol sulfate, 7-methyl hexadecanol sulfate, 8-methyl hexadecanol sulfate, 9-methyl hexadecanol sulfate, 10-methyl hexadecanol sulfate, 11-methyl hexadecanol sulfate, 12-methyl hexadecanol sulfate, 13-methyl hexadecanol sulfate, 14-methyl hexadecanol sulfate, and mixtures thereof.

Preferred di-methyl branched primary alkyl sulfates are selected from the group consisting of: 2,3-methyl tetradecanol sulfate, 2,4-methyl tetradecanol sulfate, 2,5-methyl tetradecanol sulfate, 2,6-methyl tetradecanol sulfate, 2,7-methyl tetradecanol sulfate, 2,8-methyl tetradecanol sulfate, 2,9-methyl tetradecanol sulfate, 2,10-methyl tetradecanol sulfate, 2,11-methyl tetradecanol sulfate, 2,12-methyl tetradecanol sulfate, 2,3-methyl pentadecanol sulfate, 2,4-methyl pentadecanol sulfate, 2,5-methyl pentadecanol sulfate, 2,6-methyl pentadecanol sulfate, 2,7-methyl pentadecanol sulfate, 2,8-methyl pentadecanol sulfate, 2,9-methyl pentadecanol sulfate, 2,10-methyl pentadecanol sulfate, 2,11-methyl pentadecanol sulfate, 2,12-methyl pentadecanol sulfate, 2,13-methyl pentadecanol sulfate, and mixtures thereof.

The following branched primary alkyl sulfates comprising 16 carbon atoms and having one branching unit are examples of preferred branched surfactants useful in the present invention compositions:

5-methylpentadecylsulfate having the formula:

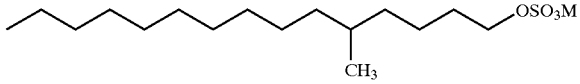

6-methylpentadecylsulfate having the formula

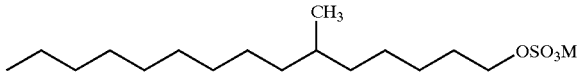

7-methylpentadecylsulfate having the formula

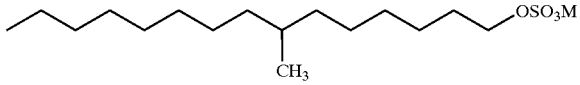

8-methylpentadecylsulfate having the formula

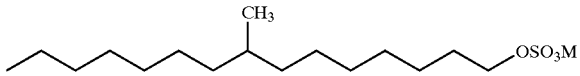

9-methylpentadecylsulfate having the formula

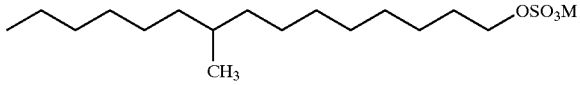

10-methylpentadecylsulfate having the formula

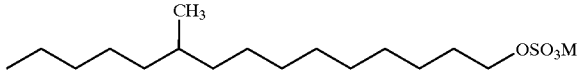

wherein M is preferably sodium.

The following branched primary alkyl sulfates comprising 17 carbon atoms and having two branching units are examples of preferred branched surfactants according to the present invention:

2,5-dimethylpentadecylsulfate having the formula:

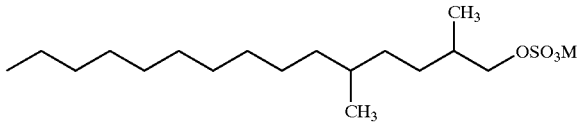

2,6-dimethylpentadecylsulfate having the formula

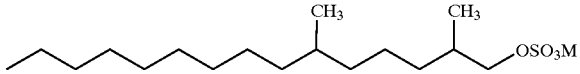

-continued 2,7-dimethylpentadecylsulfate having the formula

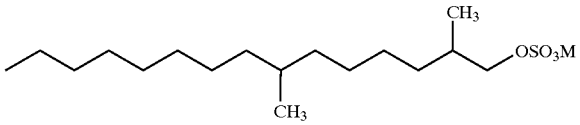

2,8-dimethylpentadecylsulfate having the formula

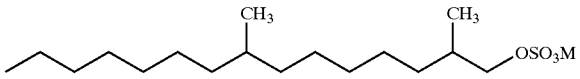

2,9-dimethylpentadecylsulfate having the formula

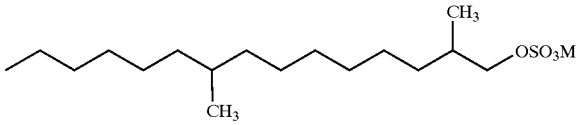

2,10-dimethylpentadecylsulfate having the formula

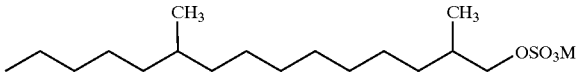

wherein M is preferably sodium.

Additional Detergent Ingredients

The compositions in accord with the invention and also the agglomerate herein may contain additional detergent components. The precise nature of these additional components, and levels of incorporation thereof will depend on the physical form of the composition or agglomerate, and the precise nature of the washing operation for which it is to be used.

The compositions of the invention preferably contain one or more additional detergent components selected from additional surfactants, bleaches, bleach catalysts, alkalinity systems, additional builders, organic polymeric compounds, enzymes, suds suppressors, lime soap, dispersants, soil suspension and anti-redeposition agents soil releasing agents, perfumes, brightners, photobleaching agents and additional corrosion inhibitors.

Additional Surfactant

The compositions or optionally also the agglomerates herein preferably contain one or more surfactants selected from nonionic, cationic, ampholytic, amphoteric and zwitterionic surfactants and mixtures thereof.

A typical listing of nonionic, ampholytic, and zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981.

Where present, ampholytic, amphoteric and zwitteronic surfactants are generally used in combination with one or more anionic and/or nonionic surfactants.

Alkoxylated Nonionic Surfactant

Essentially any alkoxylated nonionic surfactants are suitable herein. The ethoxylated and propoxylated nonionic surfactants are preferred.

Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts.

Nonionic Alkoxylated Alcohol Surfactant

The condensation products of aliphatic alcohols with from 1 to 25 moles of alkylene oxide, particularly ethylene oxide and/or propylene oxide, are suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 10 moles of ethylene oxide per mole of alcohol.

Nonionic Polyhydroxy Fatty Acid Amide Surfactant

Polyhydroxy fatty acid amides suitable for use herein are those having the structural formula $R^2CONR^1Z$ wherein: R1 is H, $C_1$–$C_4$ hydrocarbyl, 2-hydroxy ethyl, 2-hydroxy propyl, ethoxy, propoxy, or a mixture thereof, preferable C1–C4 alkyl, more preferably $C_1$ or $C_2$ alkyl, most preferably $C_1$ alkyl (i.e., methyl); and $R_2$ is a $C_5$–$C_{31}$ hydrocarbyl, preferably straight-chain $C_5$–$C_{19}$ alkyl or alkenyl, more preferably straight-chain $C_9$–$C_{17}$ alkyl or alkenyl, most preferably straight-chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Nonionic Fatty Acid Amide Surfactant

Suitable fatty acid amide surfactants include those having the formula: $R^6CON(R^7)_2$ wherein $R^6$ is an alkyl group containing from 7 to 21, preferably from 9 to 17 carbon atoms and each $R^7$ is selected from the group consisting of hydrogen, $C_1$–$C_4$ alkyl, $C_1$–$C_4$ hydroxyalkyl, and $—(C_2H_4O)_xH$, where x is in the range of from 1 to 3.

Nonionic Alkylpolysaccharide Surfactant

Suitable alkylpolysaccharides for use herein arc disclosed in U.S. Pat. No. 4.565,647, Llenado, issued Jan. 21, 1986, having a hydrophobic group containing from 6 to 30 carbon atoms and a polysaccharide, e.g., a polyglycoside, hydrophilic group containing from 1.3 to 10 saccharide units.

Preferred alkylpolyglycosides have the formula:

$$R^2O(C_nH_{2n}O)t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from 10 to 18 carbon atoms; n is 2 or 3; t is from 0 to 10, and x is from 1.3 to 8. The glycosyl is preferably derived from glucose.

Amphoteric Surfactant

Suitable amphoteric surfactants for use herein include the amine oxide surfactants and the alkyl amphocarboxylic acids.

Suitable amine oxides include those compounds having the formula $R^3(OR^4)_xN^0(R^5)_2$ wherein $R^3$ is selected from an alkyl, hydroxyalkyl, acylamidopropoyl and alkyl phenyl group, or mixtures thereof, containing from 8 to 26 carbon atoms; $R^4$ is an alkylene or hydroxyalkylene group containing from 2 to 3 carbon atoms, or mixtures thereof; x is from 0 to 5, preferably from 0 to 3; and each $R^5$ is an alkyl or hydroxyalkyl group containing from 1 to 3, or a polyethylene oxide group containing from 1 to 3 ethylene oxide groups. Preferred are $C_{10}$–$C_{18}$ alkyl dimethylamine oxide, and $C_{10-18}$ acylamido alkyl dimethylamine oxide.

A suitable example of an alkyl aphodicarboxylic acid is Miranol™ C2M Conc. manufactured by Miranol, Inc., Dayton, N.J.

Zwitterionic Surfactant

Zwitterionic surfactants can also be incorporated into the detergent compositions in accord with the invention. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Suitable betaines are those compounds having the formula $R(R')_2N^+R^2COO^-$ wherein R is a $C_6$–$C_{18}$ hydrocarbyl group, each $R^1$ is typically $C_1$–$C_3$ alkyl, and $R^2$ is a $C_1$–$C_5$ hydrocarbyl group. Preferred betaines are $C_{12-18}$ dimethylammonio hexanoate and the $C_{10-18}$ acylamidopropane (or ethane) dimethyl (or diethyl) betaines. Complex betaine surfactants are also suitable for use herein.

Cationic Surfactants

Suitable cationic surfactants to be used in the detergent herein include the quaternary ammonium surfactants. Preferably the quaternary ammonium surfactant is a mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups. Preferred are also the mono-alkoxylated and bis-alkoxylated amine surfactants.

Another suitable group of cationic surfactants which can be used in the detergent compositions or components thereof herein are cationic ester surfactants. The cationic ester surfactant is a, preferably water dispersible, compound having surfactant properties comprising at least one ester (i.e. —COO—) linkage and at least one cationically charged group.

Suitable cationic ester surfactants, including choline ester surfactants, have for example been disclosed in U.S. Pat. Nos. 4228042, 4239660 and 4260529.

In one preferred aspect the ester linkage and cationically charged group are separated from each other in the surfactant molecule by a spacer group consisting of a chain comprising at least three atoms (i.e. of three atoms chain length), preferably from three to eight atoms, more preferably from three to five atoms, most preferably three atoms. The atoms forming the spacer group chain are selected from the group consisting of carbon, nitrogen and oxygen atoms and any mixtures thereof, with the proviso that any nitrogen or oxygen atom in said chain connects only with carbon atoms in the chain. Thus spacer groups having, for example, —O—O— (i.e. peroxide), —N—N—, and —N—O— linkages are excluded, whilst spacer groups having, for example —$CH_2$—O—$CH_2$— and —$CH_2$—NH—$CH_2$— linkages are included. In a preferred aspect the spacer group chain comprises only carbon atoms, most preferably the chain is a hydrocarbyl chain.

Cationic Mono-alkoxylated Amine Surfactants

Highly preferred herein are cationic mono-alkoxylated amine surfactant preferably of the general formula I:

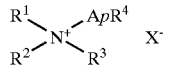

(I)

wherein $R^1$ is an alkyl or alkenyl moiety containing from about 6 to about 18 carbon atoms, preferably 6 to about 16 carbon atoms, most preferably from about 6 to about 14 carbon atoms; $R^2$ and $R^3$ are each independently alkyl groups containing from one to about three carbon atoms, preferably methyl, most preferably both $R^2$ and $R^3$ are methyl groups; $R^4$ is selected from hydrogen (preferred), methyl and ethyl; $X^-$ is an anion such as chloride, bromide, methylsulfate, sulfate, or the like, to provide electrical neutrality; A is a alkoxy group, especially a ethoxy, propoxy or butoxy group; and p is from 0 to about 30, preferably 2 to about 15, most preferably 2 to about 8.

Preferably the $ApR^4$ group in formula I has p=1 and is a hydroxyalkyl group, having no greater than 6 carbon atoms whereby the —OH group is separated from the quaternary ammonium nitrogen atom by no more than 3 carbon atoms. Particularly preferred $ApR^4$ groups are —$CH_2CH_2OH$, —$CH_2CH_2CH_2OH$, —$CH_2CH(CH_3)OH$ and —$CH(CH_3)CH_2OH$, with —$CH_2CH_2OH$ being particularly preferred. Preferred $R^1$ groups are linear alkyl groups. Linear $R^1$ groups having from 8 to 14 carbon atoms are preferred.

Another highly preferred cationic mono-alkoxylated amine surfactants for use herein are of the formula

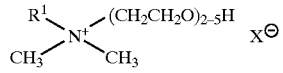

wherein $R^1$ is $C_{10}$–$C_{18}$ hydrocarbyl and mixtures thereof, especially $C_{10}$–$C_{14}$ alkyl, preferably $C_{10}$ and $C_{12}$ alkyl, and X is any convenient anion to provide charge balance, preferably chloride or bromide.

As noted, compounds of the foregoing type include those wherein the ethoxy ($CH_2CH_2O$) units (EO) are replaced by butoxy, isopropoxy [$CH(CH_3)CH_2O$] and [$CH_2CH(CH_3O$] units (i-Pr) or n-propoxy units (Pr), or mixtures of EO and/or Pr and/or i-Pr units.

The levels of the cationic mono-alkoxylated amine surfactants used in detergent compositions of the invention is preferably from 0.1% to 20%, more preferably from 0.2% to 7%, most preferably from 0.3% to 3.0% by weight of the composition.

Cationic Bis-alkoxylated Amine Surfactant

The cationic bis-alkoxylated amine surfactant preferably has the general formula II:

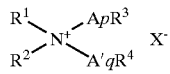

(II)

wherein $R^1$ is an alkyl or alkenyl moiety containing from about 8 to about 18 carbon atoms, preferably 10 to about 16 carbon atoms, most preferably from about 10 to about 14 carbon atoms; $R^2$ is an alkyl group containing from one to three carbon atoms, preferably methyl; $R^3$ and $R^4$ can vary independently and are selected from hydrogen (preferred), methyl and ethyl, $X^-$ is an anion such as chloride, bromide, methylsulfate, sulfate, or the like, sufficient to provide electrical neutrality. A and A' can vary independently and are each selected from $C_1$–$C_4$ alkoxy, especially ethoxy, (i.e., —$CH_2CH_2O$—), propoxy, butoxy and mixtures thereof, p is from 1 to about 30, preferably 1 to about 4 and q is from 1 to about 30, preferably 1 to about 4, and most preferably both p and q are 1.

Highly preferred cationic bis-alkoxylated amine surfactants for use herein are of the formula

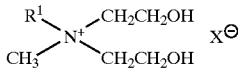

wherein $R^1$ is $C_{10}$–$C_{18}$ hydrocarbyl and mixtures thereof, preferably $C_{10}$, $C_{12}$, $C_{14}$ alkyl and mixtures thereof. X is any convenient anion to provide charge balance, preferably chloride. With reference to the general cationic bis-alkoxylated amine structure noted above, since in a preferred compound $R^1$ is derived from (coconut) $C_{12}$–$C_{14}$ alkyl fraction fatty acids, $R^2$ is methyl and $ApR^3$ and $A'qR^4$ are each monoethoxy.

Other cationic bis-alkoxylated amine surfactants useful herein include compounds of the formula:

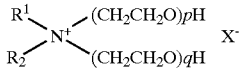

wherein $R^1$ is $C_{10}$–$C_{18}$ hydrocarbyl, preferably $C_{10}$–$C_{14}$ alkyl, independently p is 1 to about 3 and q is 1 to about 3, $R^2$ is $C_1$–$C_3$ alkyl, preferably methyl, and X is an anion, especially chloride or bromide.

Other compounds of the foregoing type include those wherein the ethoxy ($CH_2CH_2O$) units (EO) are replaced by butoxy (Bu) isopropoxy [$CH(CH_3)CH_2O$] and [$CH_2CH(CH_3O$] units (i-Pr) or n-propoxy units (Pr), or mixtures of EO and/or Pr and/or i-Pr units.

Perhydrate Bleaches

A preferred additional components of the compositions or agglomerates herein is a perhydrate bleach, such as metal perborates, metal percarbonates, particularly the sodium salts. Perborate can be mono or tetra hydrated. Sodium percarbonate has the formula corresponding to $2Na_2CO_3.3H_2O_2$, and is available commercially as a crystalline solid.

Potassium peroxymonopersulfate, sodium per is another optional inorganic perhydrate salt of use in the detergent compositions herein.

Organic Peroxyacid Bleaching System

A preferred feature of the composition or agglomerates herein is an organic peroxyacid bleaching system. In one preferred execution the bleaching system contains a hydrogen peroxide source and an organic peroxyacid bleach precursor compound. The production of the organic peroxyacid occurs by an in situ reaction of the precursor with a source of hydrogen peroxide. Preferred sources of hydrogen peroxide include inorganic perhydrate bleaches, such as the perborate bleach of the claimed invention. In an alternative preferred execution a preformed organic peroxyacid is incorporated directly into the composition. Compositions containing mixtures of a hydrogen peroxide source and organic peroxyacid precursor in combination with a preformed organic peroxyacid are also envisaged.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

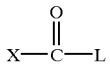

where L is a leaving group and X is essentially any functionality, such that on perhydroloysis the structure of the peroxyacid produced is

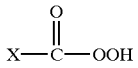

Peroxyacid bleach precursor compounds are preferably incorporated at a level of from 0.5% to 20% by weight, more preferably from 1% to 15% by weight, most preferably from 1.5% to 10% by weight of the detergent compositions.

Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilize for use in a bleaching composition.

Preferred L groups are selected from the group consisting of:

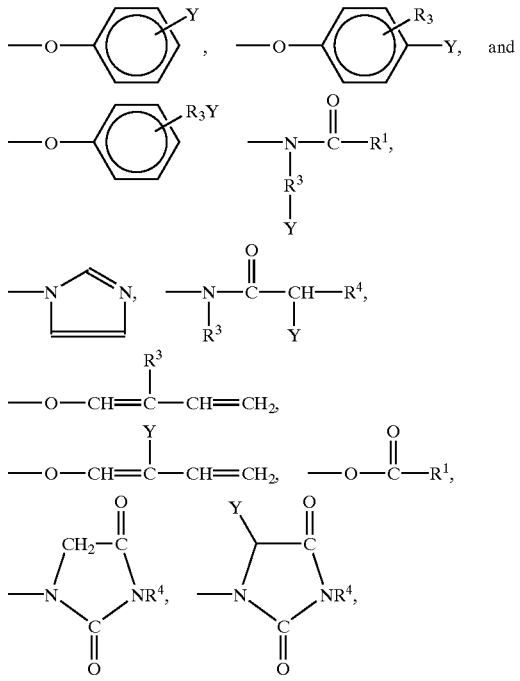

-continued

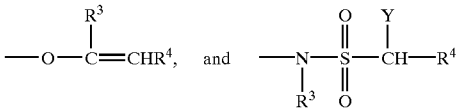

and mixtures thereof, wherein $R^1$ is an alkyl, aryl, or alkaryl group containing from 1 to 14 carbon atoms, $R^3$ is an alkyl chain containing from 1 to 8 carbon atoms. $R^4$ is H or $R^3$, and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammmonium groups.

The preferred solubilizing groups are $—SO_3^-M^+$, $—CO_2^-M^+$, $—SO_4^-M^+$, $—N^+(R^3)_4X^-$ and $O<—N(R^3)_3$ and most preferably $—SO_3^-M^+$ and $—CO_2^-M^+$ wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the $N,N,N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred. The TAED is preferably not present in the agglomerated particle of the present invention, but preferably present in the detergent composition, comprising the particle.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and pentaacetyl glucose.

Amide Substituted Plkyl Peroxyacid Precursors

Amide substituted alkyl peroxyacid precursor compounds are suitable herein, including those of the following general formulae:

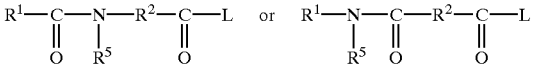

wherein $R^1$ is an alkyl group with from 1 to 14 carbon atoms, $R^2$ is an alkylene group containing from 1 to 14 carbon atoms, and $R^5$ is H or an alkyl group containing 1 to 10 carbon atoms and L can be essentially any leaving group. Amide substituted bleach activator compounds of this type are described in EP-A-0170386.

Perbenzoic Acid Precursor

Perbenzoic acid precursor compounds provide perbenzoic acid on perhydrolysis. Suitable O-acylated perbenzoic acid precursor compounds include the substituted and unsubstituted benzoyl oxybenzene sulfonates, and the benzoylation products of sorbitol, glucose, and all saccharides with benzoylating agents, and those of the imide type including N-benzoyl succinimide, tetrabenzoyl ethylene diamine and the N-benzoyl substituted ureas. Suitable imidazole type perbenzoic acid precursors include N-benzoyl imidazole and N-benzoyl benzimidazole. Other useful N-acyl group-containing perbenzoic acid precursors include N-benzoyl pyrrolidone, dibenzoyl taurine and benzoyl pyroglutamic acid.

Cationic Peroxyacid Precursors

Cationic peroxyacid precursor compounds produce cationic peroxyacids on perhydrolysis.

Typically, cationic peroxyacid precursors are formed by substituting the peroxyacid part of a suitable peroxyacid precursor compound with a positively charged functional group, such as an ammonium or alkyl ammonium group, preferably an ethyl or methyl ammonium group. Cationic peroxyacid precursors are typically present in the solid detergent compositions as a salt with a suitable anion, such as a halide ion.

The peroxyacid precursor compound to be so cationically substituted may be a perbenzoic acid, or substituted derivative thereof, precursor compound as described hereinbefore. Alternatively, the peroxyacid precursor compound may be an alkyl percarboxylic acid precursor compound or an amide substituted alkyl peroxyacid precursor as described hereinafter.

Cationic peroxyacid precursors are described in U.S. Pat. Nos. 4,904,406; 4,751,015; 4,988,451; 4,397,757; 5,269,962; 5,127,852; 5,093,022; 5,106,528; U.K. 1,382,594; EP 475,512, 458,396 and 284,292; and in JP 87-318,332.

Examples of preferred cationic peroxyacid precursors are described in UK Patent Application No. 9407944.9 and U.S. patent application Ser. Nos. 08/298903, 08/298650, 08/298904 and 08/298906.

Suitable cationic peroxyacid precursors include any of the ammonium or alkyl ammonium substituted alkyl or benzoyl oxybenzene sulfonates, N-acylated caprolactams, and monobenzoyltetraacetyl glucose benzoyl peroxides. Preferred cationic peroxyacid precursors of the N-acylated caprolactam class include the trialkyl ammonium methylene benzoyl caprolactams and the trialkyl ammonium methylene alkyl caprolactams.

Benzoxazin Organic Peroxyacid Precursors

Also suitable are precursor compounds of the benzoxazin-type, as disclosed for example in EP-A-332,294 and EP-A-482,807, particularly those having the formula:

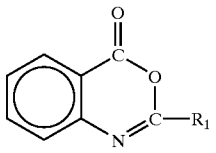

wherein $R_1$ is H, alkyl, alkaryl, aryl, or arylalkyl.

Preformed Organic Peroxyacid

The detergent composition may contain, in addition to, or as an alternative to, an organic peroxyacid bleach precursor compound, a preformed organic peroxyacid , typically at a level of from 1% to 15% by weight, more preferably from 1% to 10% by weight of the composition.

A preferred class of organic peroxyacid compounds are the amide substituted compounds of the following general formulae:

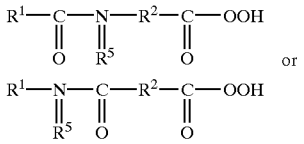

wherein $R^1$ is an alkyl, aryl or alkaryl group with from 1 to 14 carbon atoms, $R^2$ is an alkylene, arylene, and alkarylene group containing from 1 to 14 carbon atoms, and $R^5$ is H or an alkyl, aryl, or alkaryl group containing 1 to 10 carbon atoms. Amide substituted organic peroxyacid compounds of this type are described in EP-A-0170386.

Other organic peroxyacids include diacyl and tetraacylperoxides, especially diperoxydodecanedioc acid, diperoxytetradecanedioc acid and diperoxyhexadecanedioc acid. Mono- and diperazelaic acid, mono- and diperbrassylic acid and N-phthaloylaminoperoxicaproic acid are also suitable herein.

Bleach Catalyst

The composition can contain a transition metal containing bleach catalyst.

One suitable type of bleach catalyst is a catalyst system comprising a transition metal cation of defined bleach catalytic activity, such as copper, iron or manganese cations, an auxiliary metal cation having little or no bleach catalytic activity, such as zinc or aluminum cations, and a sequestrant having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

Other types of bleach catalysts include the manganese-based complexes disclosed in U.S. Pat. No. 5,246,621 and U.S. Pat. No. 5,244,594. Preferred examples of these catalysts include $Mn^{IV}_2(u\text{-}O)_3$(1,4,7-trimethyl-1,4,7-triazacyclononane)$_2$-$(PF_6)_2$, $Mn^{III}_2(u\text{-}O)_1(u\text{-}OAc)_2$(1,4,7-trimethyl-1,4,7-triazacyclononane)$_2$-$(ClO_4)_2$, $Mn^{IV}_4(u\text{-}O)_6$(1,4,7-triazacyclononane)$_4$-$(ClO_4)_2$, $Mn^{III}Mn^{IV}_4(u\text{-}O)_1(u\text{-}OAc)_2$-(1,4,7-trimethyl-1,4,7-triazacyclononane)$_2$-$(ClO_4)_3$, and mixtures thereof. Others are described in European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, 1,2,4,7-tetramethyl-1,4,7-triazacyclononane, and mixtures thereof.

The bleach catalysts useful herein may also be selected as appropriate for the present invention. For examples of suitable bleach catalysts see U.S. Pat. No. 4,246,612 and U.S. Pat. No. 5,227,084. See also U.S. Pat. No. 5,194,416 which teaches mononuclear manganese (IV) complexes such as Mn(1,4,7-trimethyl-1,4,7-triazacyclononane)$(OCH_3)_3$-$(PF_6)$.

Still another type of bleach catalyst, as disclosed in U.S. Pat. No. 5,114,606, is a water-soluble complex of manganese (III), and/or (IV) with a ligand which is a non-carboxylate polyhydroxy compound having at least three consecutive C—OH groups. Preferred ligands include sorbitol, iditol, dulsitol, mannitol, xylithol, arabitol, adonitol, meso-erythritol, meso-inositol, lactose, and mixtures thereof.

U.S. Pat. No. 5,114,611 teaches a bleach catalyst comprising a complex of transition metals, including Mn, Co, Fe, or Cu, with an non-(macro)-cyclic ligand. Said ligands are of the formula:

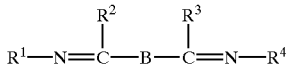

wherein $R^1$, $R^2$, $R^3$, and $R^4$ can each be selected from H, substituted alkyl and aryl groups such that each $R^1$—N═C—$R^2$ and $R^3$—C═N—$R^4$ form a five or six-membered ring. Said ring can further be substituted. B is a bridging group selected from O, S. $CR^5R^6$, $NR^7$ and C═O, wherein $R^5$, $R^6$, and $R^7$ can each be H, alkyl, or aryl groups, including substituted or unsubstituted groups. Preferred ligands include pyridine, pyridazine, pyrimidine, pyrazine, imidazole, pyrazole, and triazole rings. Optionally, said rings may be substituted with substituents such as alkyl, aryl, alkoxy, halide, and nitro. Particularly preferred is the ligand 2,2'-bispyridylamine. Preferred bleach catalysts include Co, Cu, Mn, Fe,-bispyridylmethane and -bispyridylamine complexes. Highly preferred catalysts include Co(2,2'-bispyridylamine)$Cl_2$, Di(isothiocyanato) bispyridylamine-cobalt (II), trisdipyridylamine-cobalt(II) perchlorate, Co(2,2-bispyridylamine)$_2O_2ClO_4$, Bis-(2,2'-bispyridylamine) copper(II) perchlorate, tris(di-2-pyridylamine) iron(II) perchlorate, and mixtures thereof.

Other examples include binuclear Mn complexed with tetra-N-dentate and bi-N-dentate ligands, including $N_4Mn^{III}(u\text{-}O)_2Mn^{IV}N_4)^+$ and $[Bipy_2Mn^{III}(u\text{-}O)_2Mn^{IV}bipy_2]$-$(ClO_4)_3$.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganese/ligand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

The bleach catalyst is typically used in a catalytically effective amount in the compositions and processes herein. By "catalytically effective amount" is meant an amount which is sufficient, under whatever comparative test conditions are employed, to enhance bleaching and removal of the stain or stains of interest from the target substrate. The test conditions will vary, depending on the type of washing appliance used and the habits of the user. Some users elect to use very hot water; others use warm or even cold water in laundering operations. Of course, the catalytic performance of the bleach catalyst will be affected by such considerations, and the levels of bleach catalyst used in fully-formulated detergent and bleach compositions can be appropriately adjusted. As a practical matter, and not by way of limitation, the compositions and processes herein can be adjusted to provide on the order of at least one part per ten million of the active bleach catalyst species in the aqueous washing liquor, and will preferably provide from about 1 ppm to about 200 ppm of the catalyst species in the wash liquor. To illustrate this point further, on the order of 3 micromolar manganese catalyst is effective at 40° C., pH 10 under European conditions using perborate and a bleach precursor. An increase in concentration of 3–5 fold may be required under U.S. conditions to achieve the same results.

Additioanl Builder Material

Water-Soluble Builders

The compositions or the agglomerates herein preferably contain a water-soluble builder compound, typically present in detergent compositions at a level of from 1% to 80% by weight, preferably from 10% to 60% by weight, most preferably from 15% to 40% by weight of the composition.

The detergent compositions of the invention may comprise phosphate-containing builder material, preferably comprises tetrasodium pyrophosphate or even more preferably anhydrous sodium tripolyphosphate, present at a level of from 0.5% to 60%, more preferably from 5% to 50%, more preferably from 8% to 40. It may be preferred that the composiitons are free of phosphate-containing builder material.

Suitable water-soluble builder compounds include the water soluble monomeric polycarboxylates, or their acid forms, homo or copolymeric polycarboxylic acids or their salts in which the polycarboxylic acid comprises at least two carboxylic radicals separated from each other by not more that two carbon atoms, borates, and mixtures of any of the foregoing.

The carboxylate or polycarboxylate builder can be momomeric or oligomeric in type although monomeric polycarboxylates are generally preferred for reasons of cost and performance.

Suitable carboxylates containing one carboxy group include the water soluble salts of lactic acid, glycolic acid and ether derivatives thereof. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates and the sulfinyl carboxylates. Polycarboxylates or their acids containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447. The most preferred polycarboxylic acid containing three carboxy groups is citric acid, preferably present at a level of from 0.1% to 15%, more preferably from 0.5% to 8% by weight of the composition.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000. Preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as useful builder components.

It may be preferred that the polymeric or oligomeric polycarboxylates are present at levels of less than 5%, preferably less than 3% or even less than 2% or even 0% by weight of the compositions.

Borate builders, as well as builders containing borate-forming materials that can produce borate under detergent storage or wash conditions are useful water-soluble builders herein.

Insoluble Builder Compound

The compositions or agglomerates herein may contain an insoluble builder compound, but preferably only present at a level of from 0% to 25% by weight, most preferably from 0% to 15% weight of the composition, or even 0% to 10% by weight of the composition.

Examples of largely water insoluble builders include the sodium aluminosilicates.

Suitable aluminosilicate zeolites have the unit cell formula $Na_z[(AlO_2)_z(SiO_2)_y]. xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite HS and mixtures thereof. Zeolite A has the formula:

$$Na_{12}[AlO_2)_{12}(SiO_2)_{12}]. xH_2O$$

wherein x is from 20 to 30, especially 27. Zeolite X has the formula $Na_{86}$ $[(AlO_2)_{86}(SiO_2)_{106}]$. 276 $H_2O$.

Another preferred aluminosilicate zeolite is zeolite MAP builder. Zeolite MAP is described in EP 384070A (Unilever). It is defined as an alkali metal alumino-silicate of the zeolite P type having a silicon to aluminium ratio not greater than 1.33, preferably within the range from 0.9 to 1.33 and more preferably within the range of from 0.9 to 1.2.

Of particular interest is zeolite MAP having a silicon to aluminium ratio not greater than 1.15 and, more particularly, not greater than 1.07.

In a preferred aspect the zeolite MAP detergent builder has a particle size, expressed as a $d_{50}$ value of from 1.0 to 10.0 micrometers, more preferably from 2.0 to 7.0 micrometers, most preferably from 2.5 to 5.0 micrometers.

The $d_{50}$ value indicates that 50% by weight of the particles have a diameter smaller than that figure. The particle size may, in particular be determined by conventional analytical techniques such as microscopic determination using a scanning electron microscope or by means of a laser granulometer. Other methods of establishing $d_{50}$ values are disclosed in EP 384070A.

Heavy Metal Ion Sequestrant

Heavy metal ion sequestrant are also useful additional ingredients herein. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 10%, preferably from 0.1% to 5%, more preferably from 0.25% to 7.5% and most preferably from 0.3% to 2% by weight of the compositions.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates.

Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate, 1,1 hydroxyethane diphosphonic acid and 1,1 hydroxyethane dimethylene phosphonic acid.

Other suitable heavy metal ion sequestrant for use herein include nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof.

Other suitable heavy metal ion sequestrants for use herein are iminodiacetic acid derivatives such as 2-hydroxyethyl diacetic acid or glyceryl imino diacetic acid, described in EP-A-317,542 and EP-A-399,133. The iminodiacetic acid-N-2-hydroxypropyl sulfonic acid and aspartic-acid N-carboxymethyl N-2-hydroxypropyl-3-sulfonic acid sequestrants described in EP-A-516,102 are also suitable herein. The β-alanine-N,N'-diacetic acid, aspartic acid-N,N'-diacetic acid, aspartic acid-N-monoacetic acid and imino-disuccinic acid sequestrants described in EP-A-509,382 are also suitable.

EP-A-476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are alos suitable. Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable.

Especially preferred are diethylenetriamine pentacetic acid, ethylenediamine-N,N'-disuccinic acid (EDDS) and 1,1 hydroxyethane diphosphonic acid or the alkali metal, alkaline earth metal, ammonium, or substituted ammonium salts thereof, or mixtures thereof.

Enzyme

Another preferred ingredient useful herein is one or more additional enzymes.

Preferred additional enzymatic materials include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139.

Preferred commercially available protease enzymes include those sold under the tradenames Alcalase, Savinase, Primase, Durazym, and Esperase by Novo Industries A/S (Denmark), those sold under the tradename Maxatase, Maxacal and Maxapem by Gist-Brocades, those sold by Genencor International, and those sold under the tradename Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases obtained from a special strain of B licheniformis, described in more detail in GB-1,269,839 (Novo). Preferred commercially available amylases include for example, those sold under the tradename Rapidase by Gist-Brocades, and those sold under the tradename Termamyl, Duramyl and BAN by Novo Industries A/S. Highly preferred amylase enzymes maybe those described in PCT/US9703635, and in WO95/26397 and WO96/23873.

Amylase enzyme may be incorporated into the composition in accordance with the invention at a level of from 0.0001% to 2% active enzyme by weight of the composition.

Lipolytic enzyme may be present at levels of active lipolytic enzyme of from 0.0001% to 2% by weight, preferably 0.001% to 1% by weight, most preferably from 0.001% to 0.5% by weight of the compositions.

The lipase may be fungal or bacterial in origin being obtained, for example, from a lipase producing strain of Humicola sp., Thermoinyces sp. or Pseudomonas sp. including *Pseudomonas pseudoalcaligenes* or *Pseudomas fluorescens*. Lipase from chemically or genetically modified mutants of these strains are also useful herein. A preferred lipase is derived from *Pseudomonas pseudoalcaligenes*, which is described in Granted European Patent, EP-B-0218272.

Another preferred lipase herein is obtained by cloning the gene from *Humicola lanuginosa* and expressing the gene in *Aspergillus oryza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Organic Polymeric Compound

Organic polymeric compounds are preferred additional components of the compositions herein or the agglomerates herein, where they may act such as to bind the agglomerate components together.

By organic polymeric compound it is meant herein essentially any polymeric organic compound commonly used as binder, dispersants, and anti-redeposition and soil suspension agents in detergent compositions, including any of the high molecular weight organic polymeric compounds described as clay flocculating agents herein, including quaternised ethoxylated (poly) amine clay-soil removal/anti-redeposition agent in accord with the invention.

Organic polymeric compound is typically incorporated in the detergent compositions of the invention at a level of from 0.01% to 30%, preferably from 0.1% to 15%. most preferably from 0.5% to 10% by weight of the compositions.

Examples of organic polymeric compounds include the water soluble organic homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 1000–5000 and their copolymers with maleic anhydride, such copolymers having a molecular weight of from 2000 to 100,000, especially 40,000 to 80,000.

The polyamino compounds are useful herein including those derived from aspartic acid such as those disclosed in EP-A-305282, EP-A-305283 and EP-A-351629.

Terpolymers containing monomer units selected from maleic acid, acrylic acid, polyaspartic acid and vinyl alcohol, particularly those having an average molecular weight of from 5,000 to 10,000, are also suitable herein.

Other organic polymeric compounds suitable for incorporation in the detergent compositions herein include cellulose derivatives such as methylcellulose, carboxymethylcellulose, hydroxypropylmethylcellulose and hydroxyethylcelulose.

Further useful organic polymeric compounds are the polyethylene glycols, particularly those of molecular weight 1000–10000, more particularly 2000 to 8000 and most preferably about 4000.

Highly preferred polymeric components herein are cotton and non-cotton soil release polymer according to U.S. Pat.

No. 4,968,451, Scheibel et al., and U.S. Pat. No. 5,415,807, Gosselink et al., and in particular according to U.S. application Ser. No. 60/051517.

Another organic compound, which is a preferred clay dispersant/anti-redeposition agent, for use herein, can be the ethoxylated cationic monoamines and diamines of the formula:

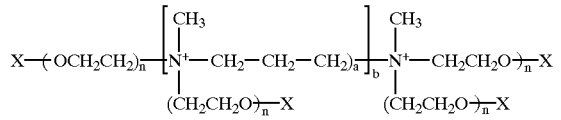

wherein X is a nonionic group selected from the group consisting of H, $C_1$–$C_4$ alkyl or hydroxyalkyl ester or ether groups, and mixtures thereof, a is from 0 to 20, preferably from 0 to 4 (e.g. ethylene, propylene, hexamethylene) b is 1 or 0; for cationic monoamines (b=0), n is at least 16, with a typical range of from 20 to 35; for cationic diamines (b=1), n is at least about 12 with a typical range of from about 12 to about 42.

Other dispersants/anti-redeposition agents for use herein are described in EP-B-011965 and U.S. Pat. No. 4,659,802 and U.S. Pat. No 4,664,848.

Suds Suppressing System

The detergent compositions of the invention, when formulated for use in machine washing compositions, may comprise a suds suppressing system present at a level of from 0.01% to 15%, preferably from 0.02% to 10%, most preferably from 0.05% to 3% by weight of the composition.

Suitable suds suppressing systems for use herein may comprise essentially any known antifoam compound, including, for example silicone antifoam compounds and 2-alkyl alcanol antifoam compounds.

By antifoam compound it is meant herein any compound or mixtures of compounds which act such as to depress the foaming or sudsing produced by a solution of a detergent composition, particularly in the presence of agitation of that solution.

Particularly preferred antifoam compounds for use herein are silicone antifoam compounds defined herein as any antifoam compound including a silicone component. Such silicone antifoam compounds also typically contain a silica component. The term "silicone" as used herein, and in general throughout the industry, encompasses a variety of relatively high molecular weight polymers containing siloxane units and hydrocarbyl group of various types. Preferred silicone antifoam compounds are the siloxanes, particularly the polydimethylsiloxanes having trimethylsilyl end blocking units.

Other suitable antifoam compounds include the monocarboxylic fatty acids and soluble salts thereof. These materials are described in U.S. Pat. No. 2,954,347, issued Sep. 27, 1960 to Wayne St. John. The monocarboxylic fatty acids, and salts thereof, for use as suds suppressor typically have hydrocarbyl chains of 10 to 24 carbon atoms, preferably 12 to 18 carbon atoms. Suitable salts include the alkali metal salts such as sodium, potassium, and lithium salts, and ammonium and alkanolammonium salts.

Other suitable antifoam compounds include, for example, high molecular weight fatty esters (e.g. fatty acid triglycerides), fatty acid esters of monovalent alcohols, aliphatic $C_{18}$–$C_{40}$ ketones (e.g. stearone) N-alkylated amino triazines such as tri- to hexa-alkylmelamines or di- to tetra alkyldiamine chlortriazines formed as products of cyanuric chloride with two or three moles of a primary or secondary amine containing 1 to 24 carbon atoms, propylene oxide, bis stearic acid amide and monostearyl di-alkali metal (e.g. sodium, potassium, lithium) phosphates and phosphate esters.

A preferred suds suppressing system comprises:

(a) antifoam compound, preferably silicone antifoam compound, most preferably a silicone antifoam compound comprising in combination
  (i) polydimethyl siloxane, at a level of from 50% to 99%, preferably 75% to 95% by weight of the silicone antifoam compound; and
  (ii) silica, at a level of from 1% to 50%, preferably 5% to 25% by weight of the silicone/silica antifoam compound;
  wherein said silica/silicone antifoam compound is incorporated at a level of from 5% to 50%, preferably 10% to 40% by weight;

(b) a dispersant compound, most preferably comprising a silicone glycol rake copolymer with a polyoxyalkylene content of 72–78% and an ethylene oxide to propylene oxide ratio of from 1:0.9 to 1:1.1, at a level of from 0.5% to 10%, preferably 1% to 10% by weight; a particularly preferred silicone glycol rake copolymer of this type is DCO544, commercially available from DOW Corning under the tradename DCO544;

(c) an inert carrier fluid compound, most preferably comprising a $C_{16}$–$C_{18}$ ethoxylated alcohol with a degree of ethoxylation of from 5 to 50, preferably 8 to 15, at a level of from 5% to 80%, preferably 10% to 70%, by weight;

A highly preferred particulate suds suppressing system is described in EP-A-0210731 and comprises a silicone antifoam compound and an organic carrier material having a melting point in the range 50° C. to 85° C., wherein the organic carrier material comprises a monoester of glycerol and a fatty acid having a carbon chain containing from 12 to 20 carbon atoms. EP-A-0210721 discloses other preferred particulate suds suppressing systems wherein the organic carrier material is a fatty acid or alcohol having a carbon chain containing from 12 to 20 carbon atoms, or a mixture thereof, with a melting point of from 45° C. to 80° C.

Other highly preferred suds suppressing systems comprise polydimethylsiloxane or mixtures of silicone, such as polydimethylsiloxane, aluminosilicate and polycarboxylic polymers, such as copolymers of laic and acrylic acid.

Polymeric Dye Transfer Inhibiting Agents

The compositions herein may also comprise from 0.01% to 10%, preferably from 0.05% to 0.5% by weight of polymeric dye transfer inhibiting agents.

The polymeric dye transfer inhibiting agents are preferably selected from polyamine N-oxide polymers, copolymers of N-vinylpyrrolidone and N-vinylimidazole, polyvinylpyrrolidonepolymers or combinations thereof, whereby these polymers can be cross-linked polymers.

Optical Brightener

The compositions herein also optionally contain from about 0.005% to 5% by weight of certain types of hydrophilic optical brighteners.

Hydrophilic optical brighteners useful herein include those having the structural formula:

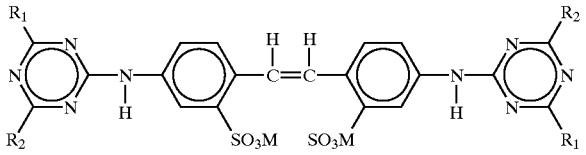

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX by Ciba-Geigy Corporation. Tinopal-CBS-X and Tinopal-UNPA-GX is the preferred hydrophilic optical brightener useful in the detergent compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species are commercially marketed under the tradename Tinopal-DMS-X and Tinopal AMS-GX by Ciba Geigy Corporation.

Polymeric Soil Release Agent

Polymeric soil release agents, hereinafter "SRA", can optionally be employed in the present compositions. If utilized, SRA's will generally comprise from 0.01% to 10.0%, typically from 0.1% to 5%, preferably from 0.2% to 3.0% by weight, of the compositions.

Preferred SRA's typically have hydrophilic segments to hydrophilize the surface of hydrophobic fibers such as polyester and nylon, and hydrophobic segments to deposit upon hydrophobic fibers and remain adhered thereto through completion of washing and rinsing cycles, thereby serving as an anchor for the hydrophilic segments. This can enable stains occurring subsequent to treatment with the SRA to be more easily cleaned in later washing procedures.

Preferred SRA's include oligomeric terephthalate esters, typically prepared by processes involving at least one transesterification/oligomerization, often with a metal catalyst such as a titanium(IV) alkoxide. Such esters may be made using additional monomers capable of being incorporated into the ester structure through one, two, three, four or more positions, without, of course, forming a densely crosslinked overall structure.

Suitable SRA's include a sulfonated product of a substantially linear ester oligomer comprised of an oligomeric ester backbone of terephthaloyl and oxyalkyleneoxy repeat units and allyl-derived sulfonated terminal moieties covalently attached to the backbone, for example as described in U.S. Pat. No. 4,968,451, Nov. 6, 1990 to J. J. Scheibel and E. P. Gosselink. Such ester oligomers can be prepared by: (a) ethoxylating allyl alcohol; (b) reacting the product of (a) with dimethyl terephthalate ("DMT") and 1,2-propylene glycol ("PG") in a two-stage transesterification/oligomerization procedure; and (c) reacting the product of (b) with sodium metabisulfite in water. Other SRA's include the nonionic end-capped 1,2-propylene/polyoxyethylene terephthalate polyesters of U.S. Pat. No. 4,711,730, Dec. 8, 1987 to Gosselink et al., for example those produced by transesterification/oligomerization of poly(ethyleneglycol) methyl ether, DMT, PG and poly(ethyleneglycol) ("PEG"). Other examples of SRA's include: the partly- and fully-anionic-end-capped oligomeric esters of U.S. Pat. No. 4,721,580, Jan. 26, 1988 to Gosselink, such as oligomers from ethylene glycol ("EG"), PG, DMT and Na-3,6-dioxa-8-hydroxyoctanesulfonate; the nonionic-capped block polyester oligomeric compounds of U.S. Pat. No. 4,702,857, Oct. 27, 1987 to Gosselink, for example produced from DMT, methyl (Me)-capped PEG and EG and/or PG, or a combination of DMT, EG and/or PG, Me-capped PEG and Na-dimethyl-5-sulfoisophthalate; and the anionic, especially sulfoaroyl, end-capped terephthalate esters of U.S. Pat. No. 4,877,896, Oct. 31, 1989 to Maldonado, Gosselink et al., the latter being typical of SRA's useful in both laundry and fabric conditioning products, an example being an ester composition made from m-sulfobenzoic acid monosodium salt, PG and DMT, optionally but preferably further comprising added PEG, e.g., PEG 3400.

SRA's also include: simple copolymeric blocks of ethylene terephthalate or propylene terephthalate with polyethylene oxide or polypropylene oxide terephthalate, see U.S. Pat. No. 3,959,230 to Hays, May 25, 1976 and U.S. Pat. No. 3,893,929 to Basadur, Jul. 8, 1975; cellulosic derivatives such as the hydroxyether cellulosic polymers available as METHOCEL from Dow; the $C_1$–$C_4$ alkyl celluloses and $C_4$ hydroxyalkyl celluloses, see U.S. Pat. No. 4,000,093, Dec. 28, 1976 to Nicol, et al.; and the methyl cellulose ethers having an average degree of substitution (methyl) per anhydroglucose unit from about 1.6 to about 2.3 and a solution viscosity of from about 80 to about 120 centipoise measured at 20° C. as a 2% aqueous solution. Such materials are available as METOLOSE SM100 and METOLOSE SM200, which are the trade names of methyl cellulose ethers manufactured by Shin-etsu Kagaku Kogyo KK.

Additional classes of SRA's include: (I) nonionic terephthalates using diisocyanate coupling agents to link polymeric ester structures, see U.S. Pat. No. 4,201,824, Violland et al. and U.S. Pat. No. 4,240,918 Lagasse et al.; and (II) SRA's with carboxylate terminal groups made by adding trimellitic anhydride to known SRA's to convert terminal hydroxyl groups to trimellitate esters. With the proper selection of catalyst, the trimellitic anhydride forms linkages to the terminals of the polymer through an ester of the isolated carboxylic acid of trimellitic anhydride rather than by opening of the anhydride linkage. Either nonionic or anionic SRA's may be used as starting materials as long as they have hydroxyl terminal groups which may be esterified. See U.S. Pat. No. 4,525,524 Tung et al. Other classes include: (III) anionic terephthalate-based SRA's of the urethane-linked variety, see U.S. Pat. No. 4,201,824, Violland et al.;

Other Optional Ingredients

Other optional ingredients suitable for inclusion in the compositions of the invention include perfumes, speckles, colours or dyes, filler salts, with sodium sulfate being a preferred filler salt.

Also, minor amounts (e.g., less than about 20% by weight) of neutralizing agents, buffering agents, phase regulants, hydrotropes, enzyme stabilizing agents, polyacids, suds regulants, opacifiers, anti-oxidants, bactericides and dyes, such as those described in U.S. Pat. No. 4,285,841 to Barrat et al., issued Aug. 25, 1981 (herein incorporated by reference), can be present.

Form of the Compositions

The composition of the invention can be made via a variety of methods, including dry-mixing, agglomerating, compaction, or spray-drying of the various compounds comprised in the detergent component, or mixtures of these techniques.

The compositions herein can take a variety of physical forms including liquid, but preferably solid forms such as tablet, flake, pastille and bar, and preferably granular or tablet forms.

The compositions in accord with the present invention can also be used in or in combination with bleach additive compositions, for example comprising chlorine bleach.

Detergent compositions herein, in particular laundry detergents, preferably have a bulk density of from 280 g/liter to 200 g/liter, or preferably from 300 g/liter or even 350 g/liter or 420 g/liter to 2000 g/liter or more preferably to 1500 g/liter or 100 g/liter or even to 700 g/liter.

Laundry Washing Method

Machine laundry methods herein typically comprise treating soiled laundry with an aqueous wash solution in a washing machine having dissolved or dispensed therein an effective amount of a machine laundry detergent composition in accord with the invention. By an effective amount of the detergent composition it is meant from 10 g to 300 g of product dissolved or dispersed in a wash solution of volume from 5 to 65 liters, as are typical product dosages and wash solution volumes commonly employed in conventional machine laundry methods.

The composition may also be formulated such that it is suitable for hard-surface cleaning or hand washing or for pre-treatment or soaking of soiled and stained fabrics.

Abbreviations used in Examples

In the detergent compositions, the abbreviated component identifications have the following meanings:

| | |
|---|---|
| LAS: | Sodium linear $C_{11-13}$ alkyl benzene sulfonate |
| MES: | α-sulpho methylester of $C_{18}$ fatty acid |
| TAS: | Sodium tallow alkyl sulfate |
| CxyAS: | Sodium $C_{1x}$–$C_{1y}$ alkyl sulfate |
| C46SAS: | Sodium $C_{14}$–$C_{16}$ secondary (2,3) alkyl sulfate |
| CxyEzS: | Sodium $C_{1x}$–$C_{1y}$ alkyl sulfate condensed with z moles of ethylene oxide |
| CxyEz: | $C_{1x}$–$C_{1y}$ predominantly linear primary alcohol condensed with an average of z moles of ethylene oxide |
| QAS: | $R_2.N^+(CH_3)_2(C_2H_4OH)$ with $R_2 = C_{12}$–$C_{14}$ |
| QAS 1: | $R_2.N^+(CH_3)_2(C_2H_4OH)$ with $R_2 = C_8$–$C_{11}$ |
| SADS: | Sodium $C_{14}$–$C_{22}$ alkyl disulfate of formula 2-(R).$C_4H_7$.-1,4-$(SO_4—)_2$ where $R = C_{10}$–$C_{18}$ |
| SADE2S: | Sodium $C_{14}$–$C_{22}$ alkyl disulfate of formula 2-(R).$C_4H_7$.-1,4-$(SO_4—)_2$ where $R = C_{10}$–$C_{18}$, condensed with z moles of ethylene oxide |
| APA: | $C_8$–$C_{10}$ amido propyl dimethyl amine |
| Soap: | Sodium linear alkyl carboxylate derived from an 80/20 mixture of tallow and coconut fatty acids |
| STS: | Sodium toluene sulphonate |
| CFAA: | $C_{12}$–$C_{14}$ (coco) alkyl N-methyl glucamide |
| TFAA: | $C_{16}$–$C_{18}$ alkyl N-methyl glucamide |
| TPKFA: | $C_{16}$–$C_{18}$ topped whole cut fatty acids |
| STPP: | Anhydrous sodium tripolyphosphate |
| TSPP: | Tetrasodium pyrophosphate |
| Zeolite A: | Hydrated sodium aluminosilicate of formula $Na_{12}(AlO_2SiO_2)_{12}.27H_2O$ having a primary particle size in the range from 0.1 to 10 micrometers (weight expressed on an anhydrous basis) |

-continued

| | |
|---|---|
| NaSKS-6 (I): | Crystalline layered silicate of formula δ-$Na_2Si_2O_5$ |
| NaSKS-6 (II): | Crystalline layered silicate of formula δ-$Na_2Si_2O_5$ of weight average particle size of 18 microns and at least 90% by weight of particle size of below 65.6 microns |
| Citric acid: | Anhydrous citric acid |
| Borate: | Sodium borate |
| Carbonate: | Anydrous sodium carbonate with a particle size between 200 μm and 900 μm |
| Bicarbonate: | Anhydrous sodium bicarbonate with a particle size distribution between 400 μm and 1200 μm |
| Silicate: | Amorphous sodium silicate ($SiO_2$:$Na_2O$ = 2.0:1) |
| Sulfate: | Anhydrous sodium sulfate |
| Mg sulfate: | Anhydrous magnesium sulfate |
| Citrate: | Tri-sodium citrate dihydrate of activity 86.4% with a particle size distribution between 425 μm and 850 μm |
| MA/AA: | Copolymer of 1:4 maleic/acrylic acid, average molecular weight about 70,000 |
| MA/AA (1): | Copolymer of 4:6 maleic/acrylic acid, average molecular weight about 10,000 |
| AA: | Sodium polyacrylate polymer of average molecular weight 4,500 |
| CMC: | Sodium carboxymethyl cellulose |
| Cellulose ether: | Methyl cellulose ether with a degree of polymerization of 650 available from Shin Etsu Chemicals |
| Protease: | Proteolytic enzyme, having 3.3% by weight of active enzyme, sold by NOVO Industries A/S under the tradename Savinase |
| Protease I: | Proteolytic enzyme, having 4% by weight of active enzyme, as described in WO 95/10591, sold by Genencor Int. Inc. |
| Alcalase: | Proteolytic enzyme, having 5.3% by weight of active enzyme, sold by NOVO Industries A/S |
| Cellulase: | Cellulytic enzyme, having 0.23% by weight of active enzyme, sold by NOVO Industries A/S under the tradename Carezyme |
| Amylase: | Amylolytic enzyme, having 1.6% by weight of active enzyme, sold by NOVO Industries A/S under the tradename Termamyl 120T |
| Amylase II: | Amylolytic enzyme, as disclosed in PCT/US9703635 |
| Lipase: | Lipolytic enzyme, having 2.0% by weight of active enzyme, sold by NOVO Industries A/S under the tradename Lipolase |
| Lipase (1): | Lipolytic enzyme, having 2.0% by weight of active enzyme, sold by NOVO Industries A/S under the tradename Lipolase Ultra |
| Endolase: | Endoglucanase enzyme, having 1.5% by weight of active enzyme, sold by NOVO Industries A/S |
| PB4: | Sodium perborate tetrahydrate of nominal formula $NaBO_2.3H_2O.H_2O_2$ |
| PB1: | Anhydrous sodium perborate bleach of nominal formula $NaBO_2.H_2O_2$ |
| Percarbonate: | Sodium percarbonate of nominal formula $2Na_2CO_3.3H_2O_2$ |
| DOBS: | Decanoyl oxybenzene sulfonate in the form of the sodium salt |
| DPDA: | Diperoxydodecanedioc acid |
| NOBS: | Nonanoyloxybenzene sulfonate in the form of the sodium salt |
| NACA-OBS: | (6-nonamidocaproyl)oxybenzene sulfonate |
| LOBS: | Dodecanoyloxybenzene sulfonate in the form of the sodium salt |
| DOBS: | Decanoyloxybenzene sulfonate in the form of the sodium salt |
| DOBA: | Decanoyl oxybenzoic acid |
| TAED: | Tetraacetylethylenediamine |
| DTPA: | Diethylene triamine pentaacetic acid |
| DTPMP: | Diethylene triamine penta(methylene phosphonate), marketed by Monsanto under the Tradename Dequest 2060 |
| EDDS: | Ethylenediamine-N,N'-disuccinic acid, (S,S) isomer in the form of its sodium salt. |

-continued

| | |
|---|---|
| Photoactivated: | Sulfonated zinc phthlocyanine encapsulated in bleach (1) dextrin soluble polymer |
| Photoactivated: | Sulfonated alumino phthlocyanine encapsulated in bleach (2) dextrin soluble polymer |
| Brightener 1: | Disodium 4,4'-bis(2-sulphostyryl)biphenyl |
| Brightener 2: | Disodium 4,4'-bis(4-anilino-6-morpholino-1.3.5-triazin-2-yl)amino)stilbene-2:2'-disulfonate |
| HEDP: | 1,1-hydroxyethane diphosphonic acid |
| PEGx: | Polyethylene glycol, with a molecular weight of x (typically 4,000) |
| PEO: | Polyethylene oxide, with an average molecular weight of 50,000 |
| TEPAE: | Tetraethylenepentaamine ethoxylate |
| PVI: | Polyvinyl imidosole, with an average molecular weight of 20,000 |
| PVP: | Polyvinylpyrolidone polymer, with an average molecular weight of 60,000 |
| PVNO: | Polyvinylpyridine N-oxide polymer, with an average molecular weight of 50,000 |
| PVPVI: | Copolymer of polyvinylpyrolidone and vinylimidazole, with an average molecular weight of 20,000 |
| QEA: | bis($(C_2H_5O)(C_2H_4O)_n$)-($CH_3$)—$N^+$—$C_6H_{12}$—$N^+$—($CH_3$) bis(($C_2H_5O$)—($C_2H_4O$))$_n$, wherein n = from 20 to 30 |
| SRP 1: | Anionically end capped poly esters |
| SRP 2: | Diethoxylated poly (1,2 propylene terephtalate) short block polymer |
| PEI: | Polyethyleneimine with an average molecular weight of 1800 and an average ethoxylation degree of 7 ethyleneoxy residues per nitrogen |
| Silicone antifoam: | Polydimethylsiloxane foam controller with siloxaneoxyalkylene copolymer as dispersing agent with a ratio of said foam controller to said dispersing agent of 10:1 to 100:1 |
| Opacifier: | Water based monostyrene latex mixture, sold by BASF Aktiengesellschaft under the tradename Lytron 621 |
| Wax: | Paraffin wax |

EXAMPLE 1

The following are detergent formulations according to the invention:

| | A | B | C | D |
|---|---|---|---|---|
| Base Powder | | | | |
| STPP | | — | 10.0 | — |
| Zeolite A | 16.0 | — | — | 16.0 |
| C45AS | 4.0 | — | 4.0 | 5.0 |
| QAS I | — | 1.0 | — | — |
| MBAS 17, 2.1 | 2.0 | 4.0 | — | — |
| $C_{25}$ $AE_3S$ | — | 1.0 | — | 1.0 |
| MA/AA | 2.0 | 1.0 | 2.0 | 1.0 |
| LAS | 4.0 | 2.0 | 3.0 | 1.6 |
| TAS | — | 4.0 | — | — |
| Silicate | — | 3.0 | — | 3.0 |
| CMC | 1.0 | 1.0 | 0.5 | 1.0 |
| Brightener 2 | 0.2 | 0.2 | — | — |
| Soap | 1.0 | — | — | 1.0 |
| DTPMP | 0.4 | 0.4 | 0.2 | 0.4 |
| Spray On | | | | |
| C45E7 | — | 2.5 | — | — |
| C25E3 | 2.5 | — | — | — |
| Silicone antifoam | 0.3 | 0.3 | 0.3 | 0.3 |
| Perfume | 0.3 | 0.3 | 0.3 | 0.3 |

-continued

| | A | B | C | D |
|---|---|---|---|---|
| Agglomerate | | | | |
| NaSKS-6 (II) | 9.0 | 16.0 | 10.0 | 6.8 |
| LAS | 6.0 | 9.0 | 5.9 | 5.0 |
| Dry additives | | | | |
| QEA | — | 0.5 | 1.0 | — |
| Carbonate | 6.0 | 13.0 | 15.0 | 13.0 |
| PB4 | 18.0 | 18.0 | 10.0 | — |
| PB1 | 4.0 | 4.0 | — | — |
| NOBS | 3.0 | 4.2 | 1.0 | — |
| Photoactivated bleach | 0.02 | 0.02 | 0.02 | 0.02 |
| Manganese catalyst | — | — | 0.5 | — |
| Protease | 1.0 | 1.0 | 1.0 | 1.0 |
| Lipase | 0.4 | 0.4 | 0.4 | 0.4 |
| Amylase | 0.25 | 0.30 | 0.15 | 0.3 |
| Dry mixed sodium sulfate | 3.0 | 3.0 | 5.0 | 3.0 |
| Balance (Moisture & Miscellaneous) | 100.0 | 100.0 | 100.0 | 100.0 |
| Density (g/liter) | 630 | 670 | 670 | 670 |

EXAMPLE 2

The following are detergent formulations according to the present invention:

| | E | F | G | H |
|---|---|---|---|---|
| Base product: | | | | |
| TAS | — | 1.0 | 4.0 | — |
| MBAS 17, 1.9 | 5.0 | 10.0 | 16.0 | 8.0 |
| C45AS | 4.0 | 4.0 | 6.0 | 6.0 |
| MES | 3.0 | — | — | — |
| QAS II | 0.4 | — | 1.0 | — |
| TFAA | — | 1.0 | — | — |
| C25E5/C45E7/$C_{25}E_3$ | — | 2.0 | — | 1.0 |
| LAS | — | 18.0 | — | — |
| Zeolite | 9.0 | 5.0 | — | 8.0 |
| Carbonate | 13.0 | 7.5 | — | 5.0 |
| Bicarbonate | — | 7.5 | — | — |
| DTPMP | 0.7 | 1.0 | — | — |
| SRP 1 | 0.3 | 0.2 | — | 0.1 |
| MA/AA | 2.0 | 1.5 | 2.0 | 1.0 |
| CMC | 0.8 | 0.4 | 0.4 | 0.2 |
| Protease | 0.8 | 1.0 | 0.5 | 0.5 |
| Amylase | 0.8 | 0.4 | — | 0.25 |
| Lipase | 0.2 | 0.1 | 0.2 | 0.1 |
| Cellulase | 0.15 | 0.05 | — | — |
| Photoactivated bleach (ppm) | 70 ppm | 45 ppm | — | 10 ppm |
| Brightener 1 | 0.2 | 0.2 | 0.08 | 0.2 |
| PB1 | 6.0 | 2.0 | — | — |
| NACA | — | — | — | 3.0 |
| NAC OBS | 2.0 | 1.0 | 0.9 | 3.1 |
| Agglomerate: | | | | |
| SKS-6 (I) | 6.6 | 6.0 | 20.0 | 10.0 |
| LAS | 3.0 | — | 15.0 | 7.0 |
| C45AS | 3.0 | 6.0 | — | — |
| Balance (Moisture and Miscellaneous) | 100 | 100 | 100 | 100 |

EXAMPLE 3

The following are detergent formulations according to the present invention:

| | I | J | K |
|---|---|---|---|
| Base Powder | | | |
| MBAS 17.5, 1.8 | — | — | 2.0 |
| Zeolite A | — | 22.0 | 6.0 |
| Sodium sulfate | 1.0 | 5.0 | — |
| MA/AA | 3.0 | 3.0 | 3.0 |
| MES | — | 5.0 | — |
| LAS | — | — | 3.5 |
| C45AS | 3.0 | 4.0 | 7.0 |
| Silicate | — | 1.0 | 5.0 |
| Soap | — | — | 2.0 |
| Brightener 1 | 0.2 | 0.2 | 0.2 |
| Carbonate | 8.0 | 16.0 | 5.0 |
| Citric acid | 3.0 | 2.0 | 1.5 |
| Spray On | | | |
| C45E5 | 1.0 | 1.0 | — |
| Agglomerate | | | |
| NaSKS-6 (I) or (II) | 17.0 | 6.0 | 7.0 |
| LAS/MES | 8.0 | 5.0 | 5.0 |
| Moisture | 0.5 | 0.1 | 0.5 |
| Dusted Zeolite | — | 0.5 | 0.5 |
| Dry additives | | | |
| PVPVI/PVNO | 0.5 | 0.5 | 0.5 |
| Protease | 1.0 | 1.0 | 1.0 |
| Lipase | 0.4 | 0.4 | 0.4 |
| Amylase | 0.1 | 0.1 | 0.1 |
| Cellulase | 0.1 | 0.1 | 0.1 |
| NOBS | — | 6.1 | — |
| NAC OBS | — | — | 4.5 |
| Sodium sulfate | — | 6.0 | — |
| Balance (Moisture and Miscellaneous) | 100 | 100 | 100 |

EXAMPLE 4

The following are high density and bleach-containing detergent formulations according to the present invention:

| | L | M | N |
|---|---|---|---|
| Blown Powder | | | |
| Zeolite A | — | — | 15.0 |
| Sodium sulfate | 0.0 | 5.0 | 0.0 |
| LAS | 3.0 | — | 3.0 |
| C45AS | 3.0 | 2.0 | 4.0 |
| QAS | — | — | 1.5 |
| DTPMP | 0.4 | 0.4 | 0.4 |
| CMC | 0.4 | 0.4 | 0.4 |
| MA/AA | 4.0 | 2.0 | 2.0 |
| Agglomerates | | | |
| QAS | 1.0 | — | — |
| LAS | — | 11.0 | 7.0 |
| TAS | 2.0 | 2.0 | 1.0 |
| Silicate | 3.0 | — | 4.0 |
| Zeolite A | 8.0 | 8.0 | 8.0 |
| Carbonate | 8.0 | 8.0 | 4.0 |
| Agglomerate | | | |
| NaSKS-6 (I) or (II) | 15.0 | 12.0 | 5.0 |
| LAS | 8.0 | 7.0 | 4.0 |
| AS | 5.0 | — | — |

-continued

| | L | M | N |
|---|---|---|---|
| Spray On | | | |
| Encapsulated Perfume | 0.3 | 0.3 | 0.3 |
| C25E3 | 2.0 | — | 2.0 |
| Dry additives | | | |
| QEA | 1.0 | 0.5 | 0.5 |
| Citric/Citrate | 5.0 | — | 2.0 |
| Bicarbonate | — | 3.0 | — |
| Carbonate | 8.0 | 15.0 | 10.0 |
| NAC OBS | 6.0 | — | 5.0 |
| Manganese catalyst | — | — | 0.3 |
| NOBS | — | 2.0 | — |
| PB1 | 14.0 | 7.0 | 10.0 |
| Polyethylene oxide of MW 5,000,000 | — | — | 0.2 |
| Bentonite clay | — | — | 10.0 |
| Citric acid | — | — | 0.5 |
| Protease | 1.0 | 1.0 | 1.0 |
| Lipase | 0.4 | 0.4 | 0.4 |
| Amylase | 0.6 | 0.6 | 0.6 |
| Cellulase | 0.6 | 0.6 | 0.6 |
| Silicone antifoam | 5.0 | 5.0 | 5.0 |
| Dry additives | | | |
| Sodium sulfate | 0.0 | 3.0 | 0.0 |
| Balance (Moisture and Miscellaneous) | 100.0 | 100.0 | 100.0 |
| Density (g/liter) | 850 | 850 | 850 |

EXAMPLE 5

The following are high density detergent formulations according to the present invention:

| | O | P | Q | R |
|---|---|---|---|---|
| Agglomerate | | | | |
| QAS | 2.0 | — | 2.0 | — |
| MES | — | 2.0 | — | — |
| LAS | 6.0 | — | — | — |
| TAS | — | 2.0 | — | — |
| C45AS | 6.0 | 4.0 | 2.0 | — |
| MBAS 16.5, 1.9 | 4.0 | — | — | — |
| Zeolite A | 15.0 | 6.0 | — | — |
| Carbonate | 4.0 | 8.0 | 4.0 | 8.0 |
| MA/AA | 4.0 | 2.0 | — | 2.0 |
| CMC | 0.5 | 0.5 | — | 0.5 |
| DTPMP | 0.4 | 0.4 | — | 0.5 |
| Spray On | | | | |
| C25E3 | 1.0 | 1.0 | — | — |
| Perfume | 0.5 | 0.5 | 0.5 | 0.5 |
| Agglomerate | | | | |
| NaSKS-6 (I) or (II) | 7.0 | 15.0 | 20.0 | 10.0 |
| LAS | 5.8 | 9.0 | 15.0 | 10.0 |
| Zeolite | — | 0.9 | — | — |
| C45AS | — | 3.0 | — | — |
| Water | 0.08 | 0.1 | — | 0.2 |
| Dry Adds | | | | |
| EDDS/HEDP | 0.5 | 0.3 | 0.5 | 0.8 |
| NaSKS 6 (I) or (II) | 5.0 | — | — | — |
| Citrate | — | 1.0 | — | — |
| Citric acid | 2.0 | — | 2.0 | 4.0 |
| NAC OBS | 4.1 | — | 5.0 | 4.0 |
| TAED | 0.8 | 2.0 | — | 2.0 |
| Percarbonate | 20.0 | 20.0 | 15.0 | 17.0 |
| SRP 1 | 0.3 | 0.3 | — | 0.3 |
| Protease | 1.4 | 1.4 | 1.0 | 0.5 |
| Lipase | 0.4 | 0.4 | 0.3 | — |
| Cellulase | 0.6 | 0.6 | 0.5 | 0.5 |
| Amylase | 0.6 | 0.6 | — | 0.3 |
| QEA | 1.0 | — | 1.0 | 1.0 |

-continued

| | O | P | Q | R |
|---|---|---|---|---|
| Silicone antifoam | 1.0 | 0.5 | 0.5 | 1.5 |
| Brightener 1 | 0.2 | 0.2 | — | 6.2 |
| Brightener 2 | 0.2 | — | 0.2 | — |
| Density (g/liter) | 850 | 850 | 800 | 775 |

EXAMPLE 6

| | S | T | U | V | W | X |
|---|---|---|---|---|---|---|
| C45AS | 11.0 | 5.0 | 4.6 | 6.5 | 4.1 | 9.0 |
| C25AES | 1.3 | 1.0 | — | 1.3 | 1.0 | — |
| LAS | — | 3.0 | 2.7 | — | 2.0 | — |
| C25E3/C25E5 | 1.5 | 4.7 | 3.3 | — | 4.7 | 3.3 |
| MBAS 16.5, 1.7 | 15.0 | 12.0 | 10.0 | 10.2 | 7.0 | 14.1 |
| QAS | — | 1.15 | 0.6 | — | 1.7 | — |
| Zeolite A | 5.0 | 16.7 | — | 7.0 | 16.7 | 11.2 |
| NaSKS-6/LAS agglomerate with ratio 5:4 | 20.0 | — | 17.5 | 20.0 | 9.0 | 17.5 |
| Citric acid | — | 1.5 | 2.5 | — | 1.5 | — |
| MA/AA | — | 0.6 | — | — | 0.6 | — |
| MA/AA 3 | — | — | 7.03 | — | — | 7.03 |
| AA | 2.3 | — | — | 2.8 | — | — |
| EDDS | — | 0.3 | — | — | 0.3 | — |
| HEDP | — | 0.5 | — | — | 0.5 | — |
| Carbonate | 6.0 | 12.5 | 14.5 | 6.0 | 12.5 | 14.0 |
| Silicate | 0.58 | 0.8 | 12 | 0.58 | 0.8 | 12 |
| PB1 | 11.0 | — | 14.0 | — | — | 4.0 |
| NACA-OBS | — | 4.7 | — | — | 2.7 | — |
| PC | — | 17.3 | — | 20.0 | 17.3 | — |
| NOBS | — | — | 4.0 | — | — | 4.0 |
| TAED | — | 2.5 | — | — | 3.5 | 2.0 |
| Protease | 0.25 | 0.36 | 0.2 | 0.26 | 0.36 | 0.2 |
| Lipase | — | — | — | — | — | — |
| Cellulase | 0.3 | 0.26 | — | 0.3 | 0.26 | — |
| Amylase | — | 0.36 | — | — | 0.36 | — |
| Brightener | 0.17 | 0.06 | 0.30 | 0.17 | 0.06 | 0.30 |
| SRP1 | 0.4 | 0.2 | 0.5 | 0.4 | 0.2 | 0.5 |
| PEG | 1.6 | — | 0.19 | 1.6 | — | 0.19 |
| Sulfate | 5.5 | 6.4 | 3.5 | 5.5 | 6.4 | 3.5 |
| CMC | — | 0.5 | — | — | 0.5 | — |
| MgSO4 | — | 0.13 | — | — | 0.13 | — |
| Photobleach | — | 0.0026 | — | — | 0.0026 | — |
| Silicone anti-foam | 0.02 | 0.21 | 0.17 | 0.02 | 0.21 | 0.17 |
| Perfume | 0.42 | 0.55 | 0.25 | 0.42 | 0.55 | 0.25 |

EXAMPLE 7

The following laundry detergent compositions Y to AB are prepared in accord with the invention:

| | Y | Z | AA | AB |
|---|---|---|---|---|
| MBAS 16.5, 1.7 | — | — | — | 5.5 |
| C45AS | 9.0 | 8.0 | 4.1 | 4 |
| C45E1S | 1.0 | — | — | — |
| LAS | — | — | 3.7 | — |
| C16 SAS | — | 2.0 | — | — |
| MES | — | — | — | 4 |
| C23E6.5 | — | 1.5 | — | 1.5 |
| NaSKS-6/LAS agglomerate with ratio 5:4 | 18.0 | 10.0 | 35.0 | 12.0 |
| Zeolite A | 7.8 | 17.0 | — | 20.0 |
| AA | 2.3 | 2.3 | 2.3 | 2.3 |
| Carbonate | 7.0 | 7.0 | 12.5 | 2.5 |
| Silicate | 0.6 | 0.6 | 0.6 | — |

-continued

| | Y | Z | AA | AB |
|---|---|---|---|---|
| Perborate/PC | 11.0 | 2.0 | — | — |
| Protease | 0.3 | 0.3 | 0.3 | 0.3 |
| Cellulase | 0.3 | 0.3 | 0.3 | 0.3 |
| SRP1 | 0.4 | 0.4 | 0.4 | 0.4 |
| Brightener | 0.2 | 0.2 | 0.2 | 0.2 |
| PEG | 1.6 | 1.6 | 1.6 | 1.6 |
| Sulfate | 5.5 | 5.5 | 5.5 | 5.5 |
| Silicone Antifoam | 0.42 | 0.42 | 0.42 | 0.42 |
| Moisture & Minors | ---Balance--- | | | |
| Density (g/L) | 663 | 663 | 663 | 663 |

EXAMPLE 8

The following laundry detergent compositions AC to AG are prepared in accord with the invention:

| | AC | AD | AE | AF | AG |
|---|---|---|---|---|---|
| MBAS 16.5, 1.7 | 14.8 | 16.4 | 12.3 | 8.2 | 4.1 |
| C45AS | 6.0 | 8.0 | 4.3 | 4.0 | 5.0 |
| C45E1S | 2.0 | — | — | 1.0 | — |
| LAS | — | — | — | 3.0 | 5.0 |
| C16 SAS | — | 1.0 | — | — | — |
| MES | — | 5.0 | — | — | — |
| TFAA | 1.6 | 0 | 0 | 0 | 0 |
| C24E3 | 4.9 | 4.9 | 4.9 | 4.9 | 4.9 |
| Zeolite A | 5.0 | 15 | — | — | — |
| NaSKS-6/LAS agglomerate with ratio 3:2 | 21 | 10 | 30 | 17 | 20 |
| Citrate/citric | 1.0 | 3 | 3 | 2.0 | — |
| MA/AA | 4.8 | 4.8 | 4.8 | 4.8 | 4.8 |
| HEDP | 0.5 | 0.5 | 0.5 | 0.5 | 0.5 |
| Carbonate | 8.5 | 8.5 | 8.5 | 8.5 | 8.5 |
| Percarbonate | 20.7 | 20.7 | 20.7 | 20.7 | 20.7 |
| TAED | 4.8 | 4.8 | — | — | 4.8 |
| NACA-OBS | — | — | 5.0 | 6.0 | 2.0 |
| Protease | 0.9 | 0.9 | 0.9 | 0.9 | 0.9 |
| Lipase | 0.15 | 0.15 | 0.15 | 0.15 | 0.15 |
| Cellulase | 0.26 | 0.26 | 0.26 | 0.26 | 0.26 |
| Amylase | 0.36 | 0.36 | 0.36 | 0.36 | 0.36 |
| SRP1 | 0.2 | 0.2 | 0.2 | 0.2 | 0.2 |
| Brightener | 0.2 | 0.2 | 0.2 | 0.2 | 0.2 |
| Sulfate | 2.3 | 2.3 | 2.3 | 2.3 | 2.3 |
| QEA | 1.0 | 1.0 | — | — | — |
| QAS | 1.0 | — | — | — | 1.0 |
| Silicone Antifoam | 0.4 | 0.4 | 0.4 | 0.4 | 0.4 |
| Moisture & Minors | ---Balance--- | | | | |
| Density (g/L) | 850 | 850 | | 850 | 850 |

EXAMPLE 9

The following formulations are examples of compositions in accordance with the invention, which may be in the form of granules or in the form of a tablet.

| | AH | AI | AJ | AK | AL |
|---|---|---|---|---|---|
| Base Product | | | | | |
| C45AS/TAS | 8.0 | 5.0 | 3.0 | 3.0 | 3.0 |
| LAS | 8.0 | — | 8.0 | — | 7.0 |
| C25AE3S | 0.5 | 2.0 | 1.0 | — | — |
| LAS/NaSKS-6 Agglomerate with ratio 3:2 | 5.0 | 17.0 | 9.0 | 20.0 | 15.0 |
| C25AE5/AE3 | 2.0 | — | 5.0 | 2.0 | 2.0 |
| QAS | — | — | — | 1.0 | 1.0 |

-continued

| | AH | AI | AJ | AK | AL |
|---|---|---|---|---|---|
| Zeolite A | 20.0 | 10.0 | 10.0 | — | 10.0 |
| NaSKS-6 (I) (dry add) | — | — | 2.0 | — | — |
| MA/AA | 2.0 | 2.0 | 2.0 | — | — |
| AA | — | — | — | — | 4.0 |
| Citrate | — | 2.0 | — | — | — |
| Citric acid | 2.0 | — | 1.5 | 2.0 | — |
| DTPA | 0.2 | 0.2 | — | — | — |
| EDDS | — | — | 0.5 | 0.1 | — |
| HEDP | — | — | 0.2 | 0.1 | — |
| PB1 | 3.0 | 5.0 | 10.0 | — | 4.0 |
| PC | — | — | — | 18.0 | — |
| NOBS | 3.0 | 4.0 | — | — | 4.0 |
| NACA OBS | — | — | 2.0 | — | — |
| TAED | — | — | 2.0 | 5.0 | — |
| Carbonate | 15.0 | 18.0 | 8.0 | 15.0 | 15.0 |
| Sulphate | 5.0 | 12.0 | 2.0 | 17.0 | 3.0 |
| Silicate | — | 1.0 | — | — | 8.0 |
| Enzyme | 0.3 | 0.3 | 1.0 | 1.0 | 0.2 |
| Minors (Brightener/SRP1/CMC/Photobleach/MgSO4/PVPVI/Suds suppressor/PEG) | 0.5 | 0.5 | 0.5 | 0.5 | 0.5 |
| Perfume | 0.2 | 0.3 | 0.5 | 0.2 | 0.1 |

What is claimed is:

1. A detergent composition comprising a detergent component selected from the group consisting of surfactants, builders, bleaches, enzymes, soil release agents, and mixtures thereof and from 0.5% to 60% by weight of a component in the form of agglomerates, said agglomerates consisting essentially of from 35% to 68% by weight of the agglomerates of crystalline layered silicate, from 32% to 55% by weight of the agglomerates of an anionic surfactant selected from the group consisting of alkylbenzene sulphonates, alkyl sulfates and alkyl ethoxysulfates and comprising less than 10% by weight of the agglomerates of free moisture, said agglomerates comprising no greater than 20% by weight of the agglomerates of additional ingredients, and wherein the agglomerates contain less than 10% by weight of the agglomerates of an aluminosilicate material.

2. A detergent composition according to claim 1 wherein the agglomerate comprises less than 5% by weight of the agglomerate of nonionic ethoxylated alcohol surfactant.

3. A detergent composition according to claim 1 wherein the crystalline layered silicate material is of the formula $NaMSi_2O_5$ y $H_2O$, whereby y is from 0 to 20, M is H, K, Na or mixtures thereof.

4. A detergent composition according to claim 1 wherein the agglomerates contain from 45% to 62% by weight of the agglomerates of the crystalline layered silicate, from 38% to 48% by weight of the agglomerates of the anionic surfactant and less than 5% by weight of the agglomerates of free moisture.

5. A detergent composition according to claim 1 whereby the builder component is present at a level of from 5% by weight to 45% of the composition.

6. A detergent composition according to claim 1 whereby the anionic surfactant comprises from 50% to 100% by weight of the anionic surfactant of a sulphonate surfactant or a mid-chain branched alkyl sulphate surfactant.

7. A detergent composition according to claim 1 comprising the agglomerate and other detergent components, obtainable by a process comprising the steps of:

a) forming of a mixture of the anionic surfactant and the crystalline layered silicate;

b) agglomerating of the mixture to form an agglomerate;

c) mixing of the agglomerate with the other detergent ingredients.

8. A method for making a detergent composition according to claim 1 by forming a mixture of the anionic surfactant and the crystalline layered silicate, subsequently agglomerating the mixture to form an agglomerate and mixing the agglomerate with the other detergent ingredients.

* * * * *